US008439704B2

(12) United States Patent
Reed

(10) Patent No.: US 8,439,704 B2
(45) Date of Patent: May 14, 2013

(54) HORIZONTALLY CONFIGURED CONNECTOR WITH EDGE CARD MOUNTING STRUCTURE

(75) Inventor: Bruce Reed, Maumelle, AR (US)

(73) Assignee: Molex Incorporated, Lisle, IL (US)

( * ) Notice: Subject to any disclaimer, the term of this patent is extended or adjusted under 35 U.S.C. 154(b) by 54 days.

(21) Appl. No.: 13/062,360

(22) PCT Filed: Sep. 9, 2009

(86) PCT No.: PCT/US2009/056297

§ 371 (c)(1),
(2), (4) Date: Jun. 15, 2011

(87) PCT Pub. No.: WO2010/030618

PCT Pub. Date: Mar. 18, 2010

(65) Prior Publication Data

US 2011/0256776 A1 Oct. 20, 2011

Related U.S. Application Data

(60) Provisional application No. 61/095,450, filed on Sep. 9, 2008, provisional application No. 61/110,748, filed on Nov. 3, 2008, provisional application No. 61/117,470, filed on Nov. 24, 2008, provisional application No. 61/153,579, filed on Feb. 18, 2009, provisional application No. 61/170,956, filed on Apr. 20, 2009, provisional application No. 61/171,066, filed on Apr. 20, 2009, provisional application No. 61/171,037, filed on Apr. 20, 2009.

(51) Int. Cl.
*H01R 13/648* (2006.01)

(52) U.S. Cl.
USPC ..... 439/607.06; 439/607.07; 439/497; 439/579

(58) Field of Classification Search ..... 439/607.06, 439/607.07, 497, 579, 701
See application file for complete search history.

(56) References Cited

U.S. PATENT DOCUMENTS

| | | | | |
|---|---|---|---|---|
| 6,083,047 | A * | 7/2000 | Paagman | 439/607.07 |
| 6,102,747 | A * | 8/2000 | Paagman | 439/701 |
| 6,273,762 | B1 * | 8/2001 | Regnier | 439/701 |
| 6,685,510 | B1 | 2/2004 | Wu | |
| 6,773,305 | B2 * | 8/2004 | Wu | 439/607.07 |
| 6,857,912 | B2 * | 2/2005 | Wu | 439/701 |
| 6,926,553 | B2 | 8/2005 | Wu | |
| 7,160,135 | B1 | 1/2007 | Wu | |

* cited by examiner

*Primary Examiner* — Gary F. Paumen
(74) *Attorney, Agent, or Firm* — Stephen L. Sheldon; Clarence R. Moon, III

(57) ABSTRACT

A connector has a plurality of mating blades in the form of circuit cards, arranged horizontally in a vertical stack. The circuit cards are supported in a vertical array in mating portions of the connector and are enclosed by sidewalls of the mating portions. In order to support the circuit cards, the sidewalls of each mating portion are slotted and the circuit cards are provided with mounting wings that extend outwardly therefrom and which are received in the slots. Reentrant notches are provided in the circuit cards adjacent where the wings extend out from the bodies of the circuit cards.

17 Claims, 27 Drawing Sheets

HORIZONTALLY CONFIGURED CONNECTOR WITH EDGE CARD MOUNTING STRUCTURE

REFERENCES TO RELATED APPLICATIONS

This application is a national phase of international application PCT/US09/56297, filed Sep. 9, 2009 and claims priority to U.S. Provisional Appln. No. 61/095,450, filed Sep. 9, 2008, Appln. No. 61/110,748, filed Nov. 3, 2008; Appln. No. 61/117,470, filed Nov. 24, 2008, Appln. No. 61/153,579, filed Feb. 18, 2009, Appln. No. 61/170,956 filed Apr. 20, 2009, Appln. No. 61/171,037, filed Apr. 20, 2009 and Appln. No. 61/171,066, filed Apr. 20, 2009, all of which are incorporated herein by reference in their entirety. This application was filed concurrently with the following applications, which are not admitted as prior art to this application and which are incorporated herein by reference in their entirety:

Application Ser. No. PCT/US09/56294, filed Sep. 9, 2009, entitled HORIZONTALLY CONFIGURED CONNECTOR, and which during national phase became U.S. Pat. No. 8,241,045 issued Aug. 14, 2012; and Application Ser. No. PCT/US09/56295, filed Sep. 9, 2009, entitled CONNECTOR WITH INTEGRATED LATCH ASSEMBLY, and which during national phase became U.S. Pat. No. 8,187,019 issued May 29, 2012.

BACKGROUND OF THE INVENTION

The present invention generally relates to connectors suitable for transmitting data, more specifically to input/output (I/O) connectors suitable for dense connector configurations that utilize a vertical array of mating blades.

One aspect that has been relatively constant in recent communication development is a desire to increase performance. Similarly, there has been constant desire to make things more compact (e.g., to increase density). For I/O connectors using in data communication, these desires create somewhat of a problem. Using higher frequencies (which are helpful to increase data rates) requires good electrical separation between signal terminals in a connector (so as to minimize cross-talk, for example). Making the connector smaller (e.g., making the terminal arrangement more dense), however, brings the terminals closer together and tends to decrease the electrical separation, which may lead to signal degradation.

In addition to the desire at increasing performance, there is also a desire to improve manufacturing. For example, as signaling frequencies increase, the tolerance of the locations of terminals, as well as their physical characteristics, become more important. Therefore, improvements to a connector design that would facilitate manufacturing while still providing a dense, high-performance connector would be appreciated.

Additionally, there is a desire to increase the density of I/O plug-style connectors and this is difficult to do without increasing the width of the connectors. Increasing the width of the connector leads to difficulty in fitting the connector into standard width routers and/or servers, and would require a user to purchase non-standard equipment to accommodate the wider plug convertors. Accordingly, certain individuals would appreciate an improved connector with increased density.

SUMMARY OF THE INVENTION

In an embodiment, a connector is provided that has a housing with a mating portion that supports a plurality of mating blades. The mating blades have a first and a second edge and wires of cables are terminated along the second edge. The first edge of the mating blades has a plurality of conductive contact pads arranged thereon to provide points of contact with a plurality of terminals of an opposing, mating connector. The mating portion supports the mating blades in a vertical stack. In an embodiment with multiple mating portions, the housing may include multiple portion that are joined together to form the housing and the mating portions may be formed from two housing portions that are joined together horizontally along vertical mating faces and the mating faces may positioned along a centerline of an associated mating portion. In an embodiment, the two portions that form the mating portion can be coupled together with a fastener positioned in the mating portion.

The housing can support two mating blades so that they are lying in two different horizontal planes that are vertically spaced apart. The mating blade can be configured to engage opposing sidewalls of the mating portions of the connector housing and may include wings that are received in slots formed in sidewalls of the mating portion. The wings of the circuit cards can be staggered so to ensure proper orientation within the connector housing during the assembly of the connectors and can have sufficient length to provide support for the circuit cards during cycles of mating and unmating with an opposing connector.

BRIEF DESCRIPTION OF THE DRAWINGS

Throughout the course of the following detailed description, reference will be made to the drawings in which like reference numbers identify like parts and in which.

DETAILED DESCRIPTION OF THE ILLUSTRATED EMBODIMENTS

Figure 1:
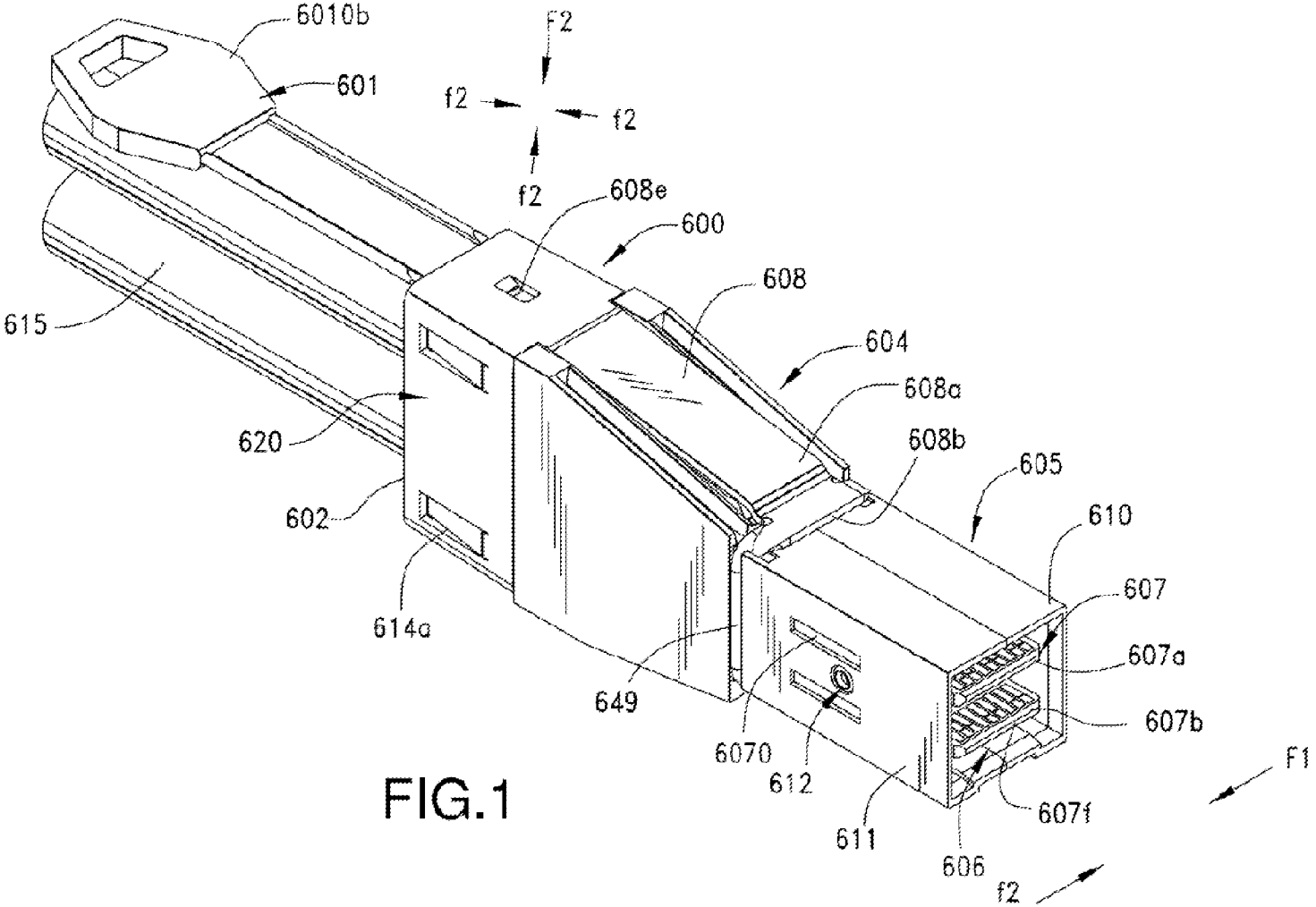
FIG. 1 is a perspective view of an embodiment of a multiple edge card connector.

As required, detailed embodiments are disclosed herein; however, it is to be understood that the disclosed embodiments are merely exemplary and may be embodied in various forms. Therefore, specific details disclosed herein are not to be interpreted as limiting, but merely as a basis for the claims and as a representative basis for teaching one skilled in the art to variously employ the disclosure in virtually any appropriate manner, including employing various features disclosed herein in combinations that might not be explicitly disclosed herein.

The features that are discussed below, at least in certain embodiments, can help provide a plug connector that has a higher circuit density without unduly increasing the width of the connector. The use of the vertically stacked mating blades helps provide such functionality but as can be appreciated, a particular embodiment may provide a wider or narrower plug connector based on trade-offs such as cost of components and the desire to be able to disassemble the connector.

Regarding a connector generally, as can be appreciated, a wide range of possible configurations may be used and various embodiments of possible connectors are illustrated in the figures. As can be appreciated, the connector configurations include a fastener positioned between two parallel mating blades (e.g., circuit cards). The fastener holds the connectors housing together and depending on its location, the fastener can also be used to stop to prevent over insertion of the connector into a mating receptacle (thus helping prevent excessive forces from being applied to the terminals and/or the circuit cards).

As can be appreciated, this allows the circuit cards position to be controlled with a high degree of precision while minimizing component costs. Furthermore, as the portion of the connector with the circuit cards will be positioned inside the mating receptacle, shielding issues are not created.

As can be further appreciated, a three-piece housing may be used to provide for a ganged plug assembly such as would be suitable for mating with two ports of an opposing ganged 1×4 connector.

FIGS. 1-4 illustrate an exemplary embodiment of a connector 600. The connector 600 is seen to have a hollow connector housing 601 with an enlarged body portion 604 and an elongated mating portion 605, having a hollow interior recess 606 that supports a pair of mating blades 607 (also known as circuit cards) therein to which individual wires 616 enclosed in cables 615 are terminated. The circuit cards 607 mate with and engage conductive terminals of an opposing mating connector (not shown) in order to connect the terminals to the wires 616 of the cables 615. In this regard, the circuit card 607 takes the form of what is sometimes referred to in the art as "paddle cards" and the circuit cards are arranged in vertically-spaced apart orientation, preferably parallel to each other. In this manner, the number of circuits in the connector 600 to connected to an opposing mating connector, (not shown) is increased (in the configuration illustrated, the number is doubled) without increasing the widthwise dimensions of the connector 600. The vertical orientation of the connector housing body portion 604 permits two or more wire cables 615, to which the connector 600 is coupled to, to be arranged vertically, preferably one above another so that the overall width of the connector is not increased. As noted below, the connector housing 601 can be provided with a specially configured rear end in order to reliably grip the cables 615 and hold them in their preferred vertical orientation.

Figure 11:
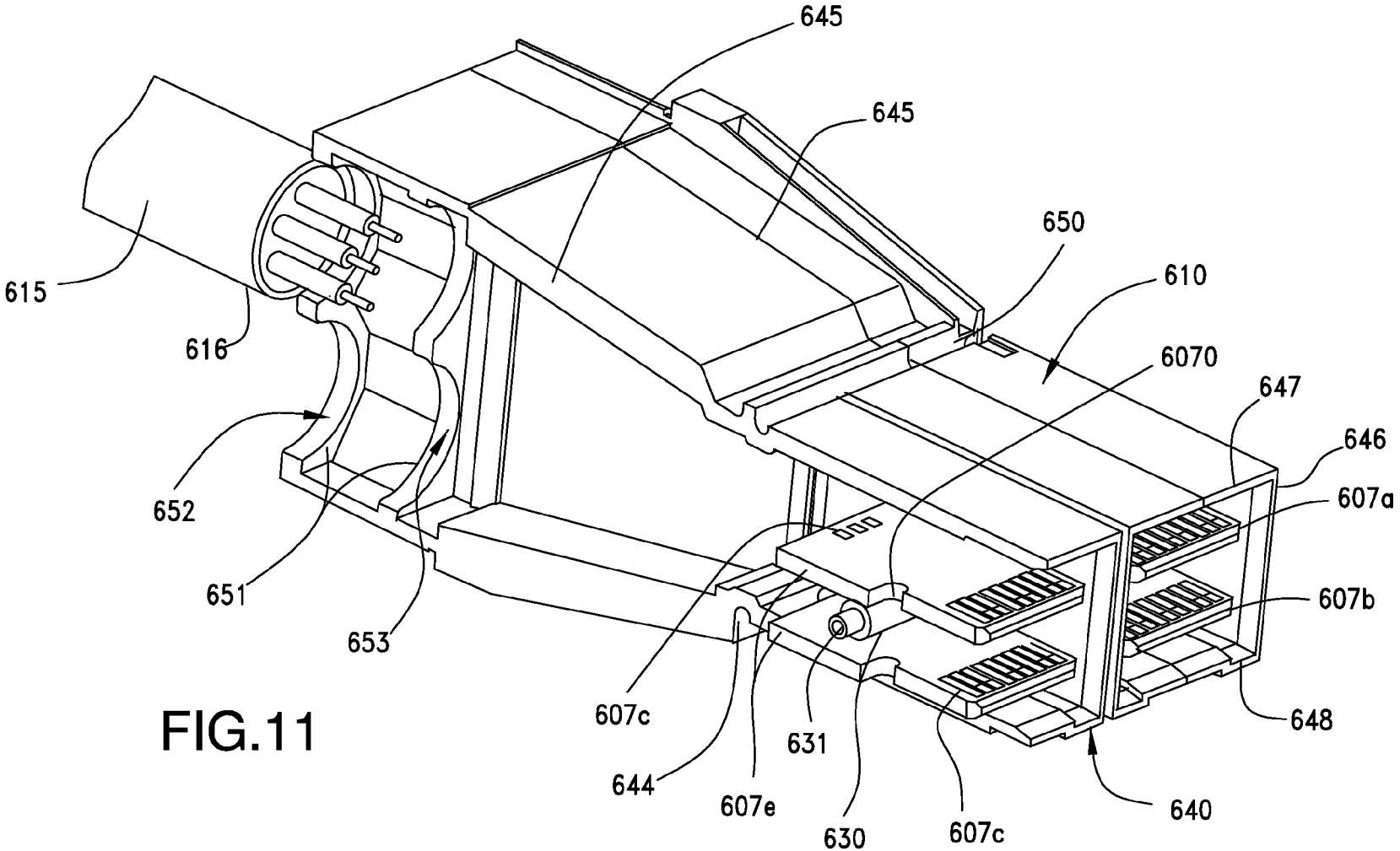
FIG. 11 is a sectional view of the connector of FIG. 9, with the right side housing half removed.
Figure 12:
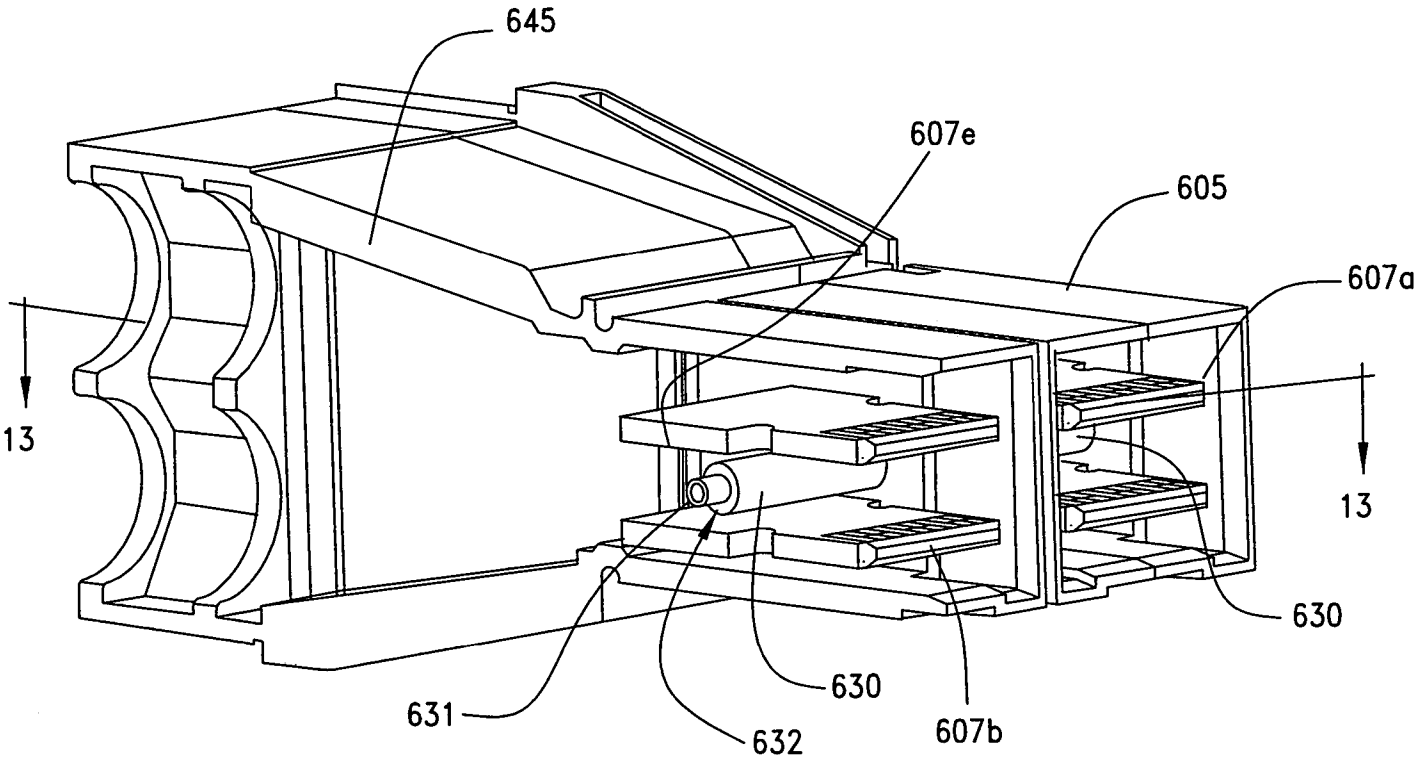
FIG. 12 is the same as FIG. 11 but taken from a frontward angle.

The connector housing body portion 604 is larger in size than its adjacent narrow mating portion 605, particularly in the height dimension. As such, the body portion 604 has a greater height than that of the mating portion 605. The interior of the connector housing 601 includes a hollow interior cavity 602, as can be appreciated from FIGS. 6 and 11. The interior cavity 602 occupies most of the connector housing 601, particularly the body portion 604 thereof and it communicates with the hollow interior recess 606 defined within the mating portion 605.

As depicted, the connector housing 601 is formed from two distinct parts, shown as housing halves 610, 611 which are respectively arranged as left and right or first and second housing halves. If desired, the housing halves 610, 611 may be mirror images of each other. These housing halves 610, 611 can be assembled together in a horizontal, or widthwise, direction and can be retained together along opposing mating faces by at least two fasteners. The front fastener 612 is disposed proximate the connector housing mating portion 605, while the rear fastener clip 620 is preferably disposed at the connector housing body portion. It can be appreciated from the Figures that both fastener apply a retaining force on the connector housing 601 that maintains the first and second connector housing halves 610, 611 thereof together in mating engagement. This retaining force may desirably be a compressive, or clamping force. The two fasteners can force the two connector housing halves into contact with each other along opposing vertical mating faces that extend longitudinally through the connector housing 601. As shown in the embodiment of FIGS. 1-6, the mating faces are aligned along a vertical axis and are coincident with a longitudinal centerline of the connector, but it will be understood that such a mating line may be offset, i.e., the bottom edge of the first connector housing half 610 may extend further than the edge thereof, as shown in the embodiment illustrated in FIGS. 21-25.

Figure 6:
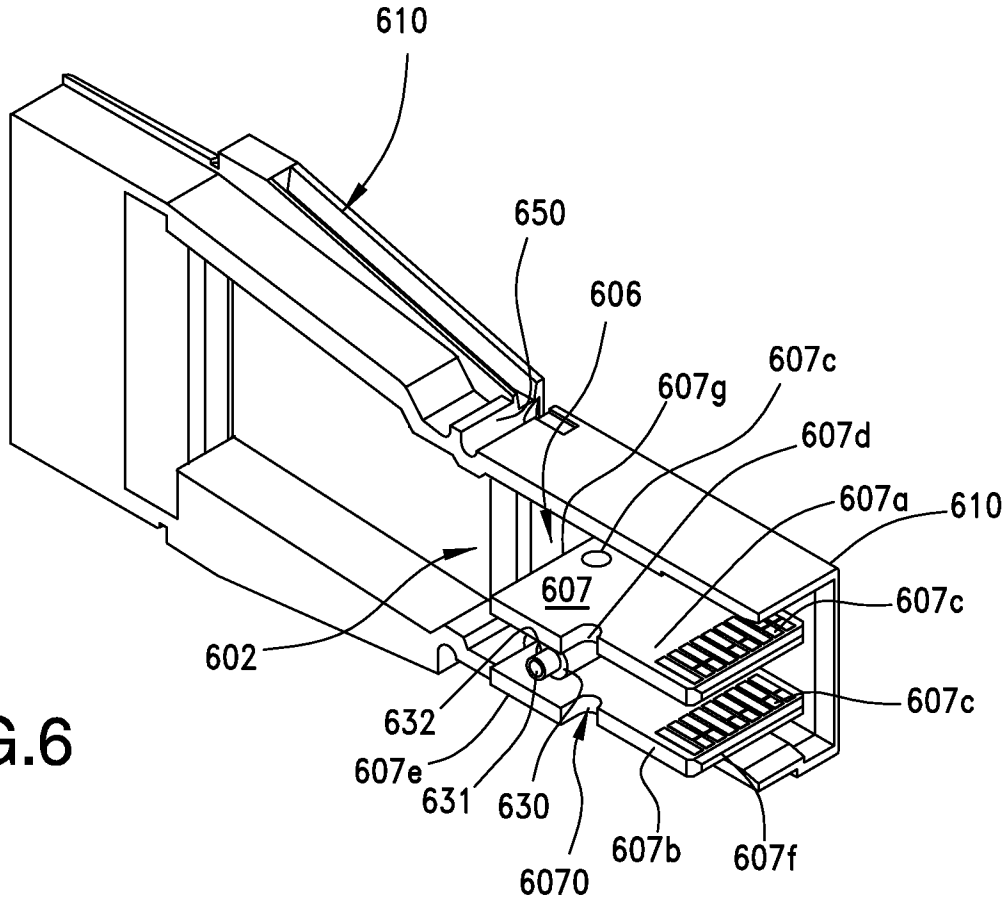
FIG. 6 is a partially exploded view of the left side of the connector housing of the connector of FIG. 1.

In order to apply the desired retaining force at the mating portion 605 of the connector, the front fastener may include a horizontally extending fastening post 630. (FIG. 6.) This post may be any desirable shape such as cylindrical or square. The housing halves lend themselves to being easily manufactured by a casting process and as such, the fastening post 630 may be integrally cast with one of the housing halves 610. The post 630 shown has a narrow swaging lug 631 at its free end 632 that is preferably received in a corresponding opening 633 formed in the opposing connector housing half 611. When the housing halves are assembled together, the lug 631 can be swaged, or dead-headed within the opening to effect a connection. Alternatively, other fasteners such as screw and threaded boss or rivet combinations combination may be used.

Figure 13:
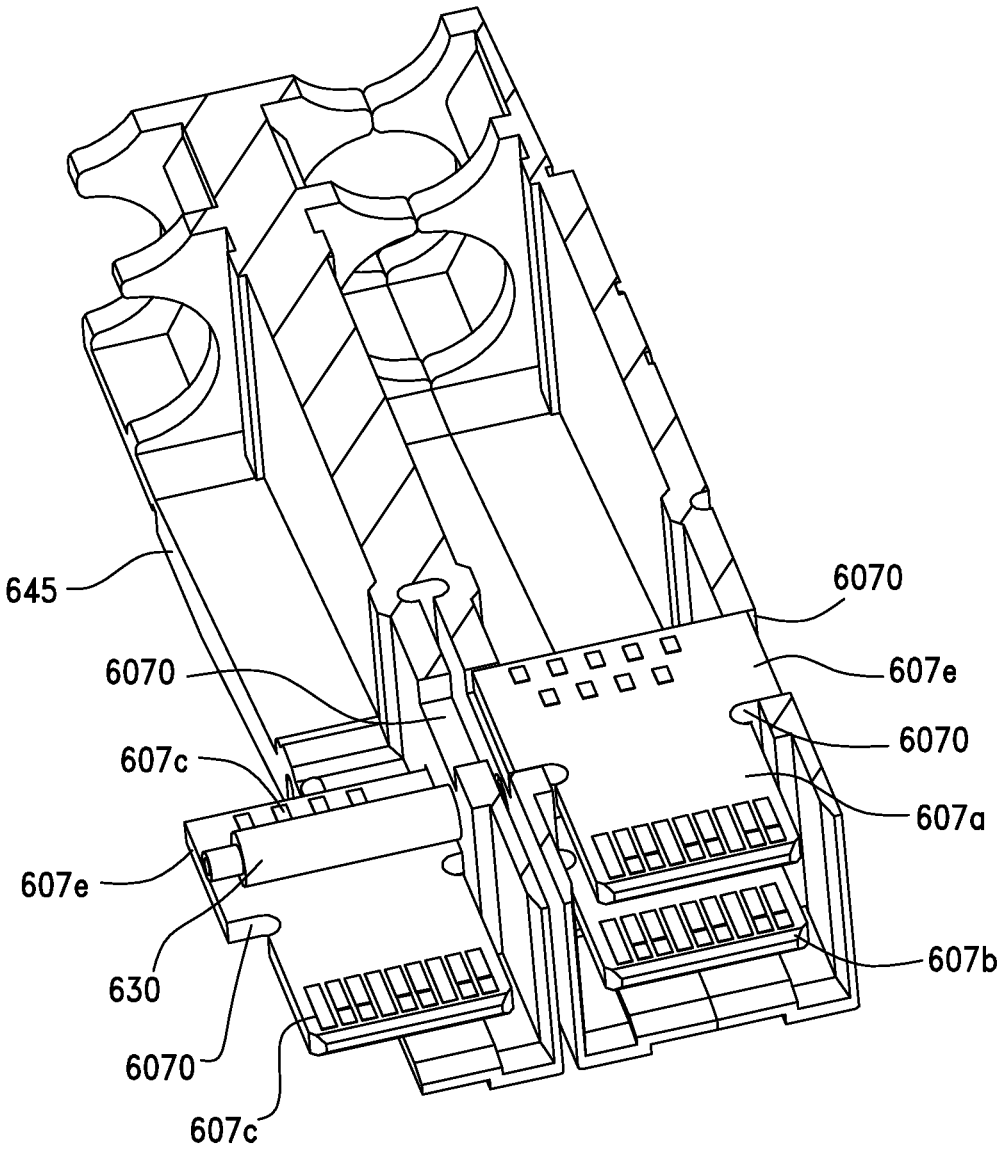
FIG. 13 is a sectional view of FIG. 12, taken along lines 13-13 thereof.
Figure 13A:
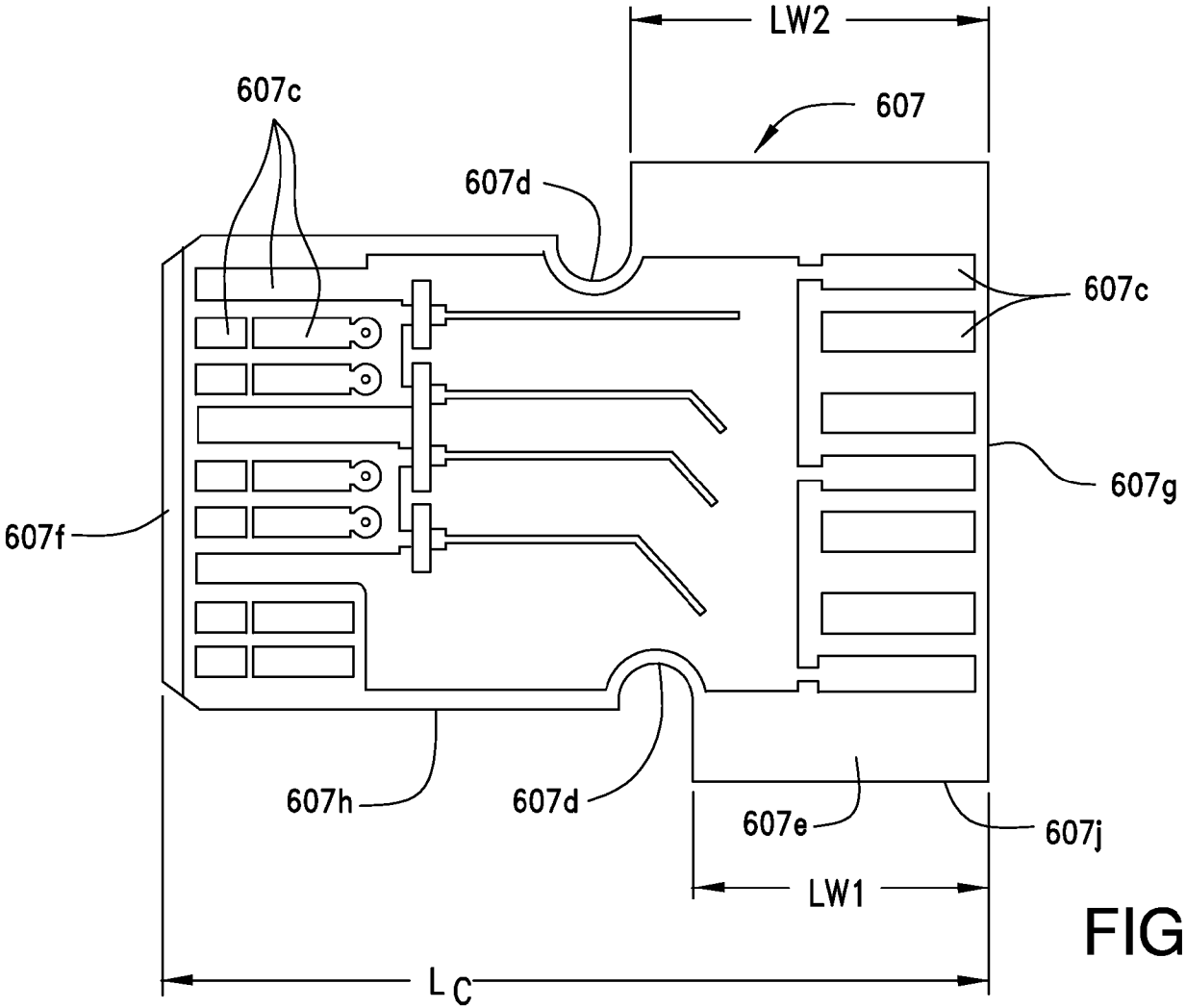
FIG. 13A is a plan view of a circuit card used in connectors of the invention.

In the embodiment illustrated, the first fastener 612 is preferably located in the vertical, intervening space that is disposed between the two circuit cards 607*a*, 607*b* and advantageously, does not increase the overall height of the mating portion 605 but takes advantage of the space used to separate the two circuit cards 607*a*, 607*b* referring to FIG. 13A. The circuit cards 607*a*, 607*b* have contact pads 607*c* arranged along their leading edges 607*f* for connection to terminals of an opposing mating connector and along the trailing edges 607*g* for connection to wires 616 of the cables 615 terminated to the connector. As seen in FIG. 6, locating the front fastening post 630 between the two circuit cards 607*a*, 607*b* also permits the post 630 to act as a stop that limits the extent to which the connector 600 can be inserted into an opposing receptacle connector.

As noted above, the body portion 604 is larger than the mating portion 605, specifically with respect to its height. This is important in that it permits the cables 615 to be stacked, or arranged vertically, as they enter the body portion at the rear of the housing 601. In this manner, the increase in density of circuits in the connector 600 does not result in an increase in the overall width of the connector. In this regard, the body portion 604 preferably has a configuration of an irregular polygon, with a trapezoidal-type configuration being shown in FIGS. 1-13, although regular polygons such as rectangular bodies or the stepped configuration of the embodiment of FIGS. 21-25, may also be used.

The circuit card 607 may include a feature useful for orienting itself within the hollow interior 606 and for engaging the housing halves 610, 611. The feature can take the form of one or more notches 607*d* that are formed in opposite sides of the cards 607 that receive lugs or columns, (not shown) that may be formed in the inner surface of the housing halves 610, 611. The notches 607*d* may also be utilized in embodiments where the connector body portion is molded over the circuit cards 607*a, b*. In this instance, the molding material will flow into and fill the notches 607*d* to hold them in place, especially in the horizontal direction.

A wing, or tab, 607*e* that projects outwardly widthwise from the body portions of the circuit cards can also be used. The wing 607*e* engages the slot 6070 formed in the housing halves 610, 611. The wing 607*e* can extend from the circuit card a distance that is enough so that the wing 607*e* extends into the slot 6070 a sufficient distance to provide reliable support in the connector housing, but does not extend so far that the edge of the wing 607*e* projects excessively past the outer side surfaces of the connector housing mating portion (s) 605. It has been determined that a wing that extends a distance of about 1.5 mm (0.045 in.) can provide reliable support.

The circuit card wing 607*e* is preferably sized so as to fit tightly in the connector housing mating portion sidewall slots 6070. In this manner, the top and bottom edges 6071 of the slots 6070 fix the circuit cards 607*a, b* vertically within the connector housing 601, and the front and rear edges 6072 of the slots 6070 fix the circuit cards 607 horizontally within the connector housing 601, e.g., the slots fix the circuit cards within the connector housing. In this manner, the slots engage and support the circuit cards both vertically and horizontally. It is also desirable that the wings 607*e* of the circuit cards 607 have a length that is long enough to support the circuit cards and resist deflection of them due to forces encountered when mating the connectors of the invention to opposing connectors. The lengths, LW1, LW2 (FIG. 13A) are preferably chosen so they will provide this support. It should be noted that while a single wing is depicted, more than one wing on a side of the circuit card could also be used. If a single wing is provided on each side of the circuit card, a length of at least 33% of the total length of the circuit card has been found to be desirable. In an embodiment the length of the wing can be between 40 and 60% of the total circuit card length. In an embodiment, the wings 607*e* give the circuit cards 607 a T-shaped configuration.

The use of such a wing-slot support arrangement also facilitates a reduction in the width of such a connector as compared to a connector that uses horizontal support edges on the interior wall of the connector housing. In such a connection, due to the conductive nature of the die cast housing, the width of the circuit cards would need to be increased in order to keep circuitry thereupon from coming into contact with any supports (e.g., the supports would extend toward the circuitry on the circuit card). With the use of the wings 607*e*, however, the wings can extend into the connector housing sidewalls slots 6070 without fear of any shorting contact from occurring. Also, as illustrated in FIG. 13A, the circuit card wings 607*e* may have different lengths (or may be offset) and the notches 607*d* positioned at the intersection of the front edges of the wings 607*e* and the circuit card body portion edges can be offset from each other. This provides a polarizing aspect to facilitate the correct assembly of the circuit cards 607*a*, 607*b* into the connector 600. This offset distance "D" (FIG. 13A) of the wings 607*e* (and notches 607*d*), along with the difference in the wing length, ensures that the circuit card is assembled in the housing with the desired orientation.

Additionally, offsetting the notches 607*d* prevents them from being aligned with each other so as to avoid narrowing the width of the circuit card between the two notches 607*d*, which could result in a weakened structural integrity of the circuit cards. Still further, the notches 607*d* are positioned on the circuit cards 607 at the intersection of the wings 607*e* with the side edges 607*h* of the body portions of the circuit cards 607. In this manner, the front vertical edges of the slots 6085 are able to contact the front edges of the wings rather than engage a chamfer that might exist between the side edge 607*h* and the wing 607*e*. In effect, the notches 607*d* act as reentrant portions that eliminate the hard right angle corner where the front edges of the wings 607*e* meet the side edges 607*h* of the circuit card body portions.

The rear fastening clip 620 also applies a retaining force to the two housing halves 610, 611. The rear fastening clip 607 can take the form of a retainer that preferably includes a collar portion 621 that at least partially, encircles, and preferably entirely encompasses, the exterior perimeter, or circumference of the connector body portion 604 near the trailing, or proximal end of the connector 600. The collar portion 621 slips over the body portion 604 and preferably in the form of an interference fit, engages the housing body portion 604 in a manner so as to press the two housing halves together along their opposing mating faces.

Figure 5:
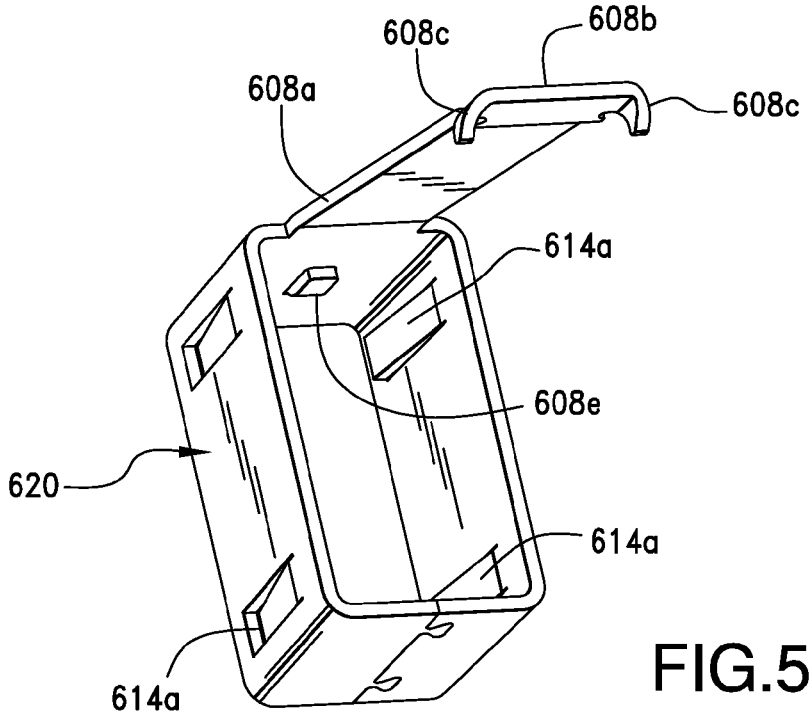
FIG. 5 is a perspective view of the retainer of the connector of FIG. 1 taken from the lower front end thereof, and having the form of a continuous retaining collar.
Figure 5A:
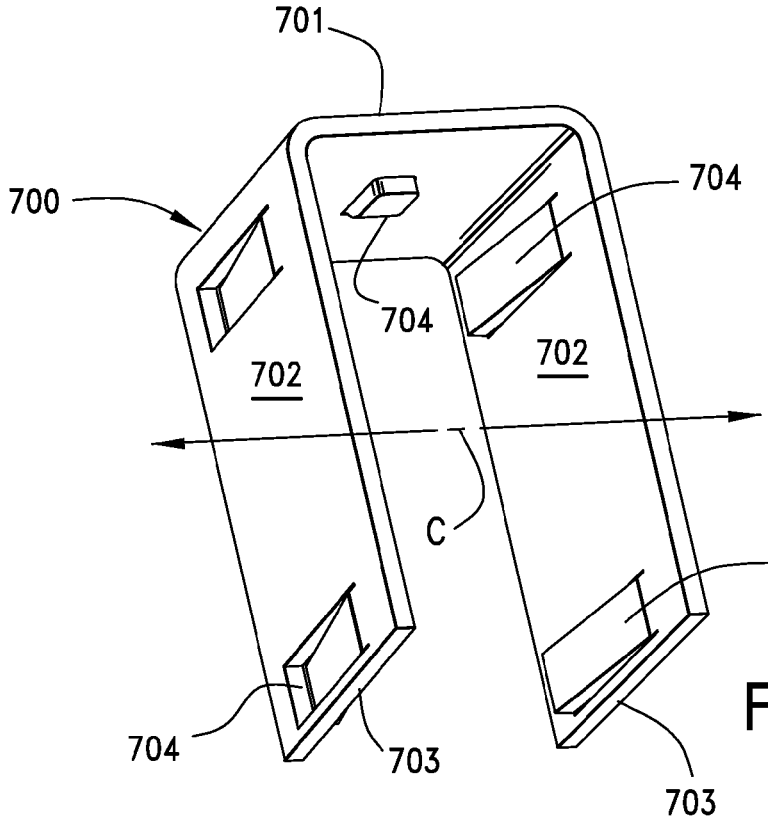
FIG. 5A is a perspective view of another embodiment of a retainer, wherein the retainer has a general U-shape with an open end.

As shown in FIG. 5A, one type of retainer 700 may have a general U-shape with a backbone portion 701 and two leg portions 702 that terminate in free ends 703. Engagement members 704 may be stamped, or otherwise formed, in the retainer 700 in order to 514*b* engage recesses 614*b* formed on the connector housing 601 and particularly in the housing channel 625. The retainer engagement members 704 are shown arranged proximate the free ends 703, proximate the junction of the backbone portion 701 to a leg portion 702 and on the backbone portion itself. The length of the leg portions 702 in such that the retainer 700 will desirably contact more than one-half of the circumference connector housing so that this style of retainer will exert a clamping force on the two connector housing halves 610, 611. This length should preferably extend past the line "C" shown in FIG. 6*a* which is the midpoint of the leg portion length. The rear fastening member engages the connector housing in a circumferential manner, meaning it engages enough at the circumference to exert a clamping force on the two housing halves 610, 611. As noted, this will typically require that it extend on the connector housing more than one-half of the circumference, but it will be noted that in square or rectangular housings, engagement of three of the four sides, will provide a clamping force. It is preferred, as shown in FIG. 5A that the retainer leg portions have at least some engagement members 704 near their free ends.

Figure 5B:
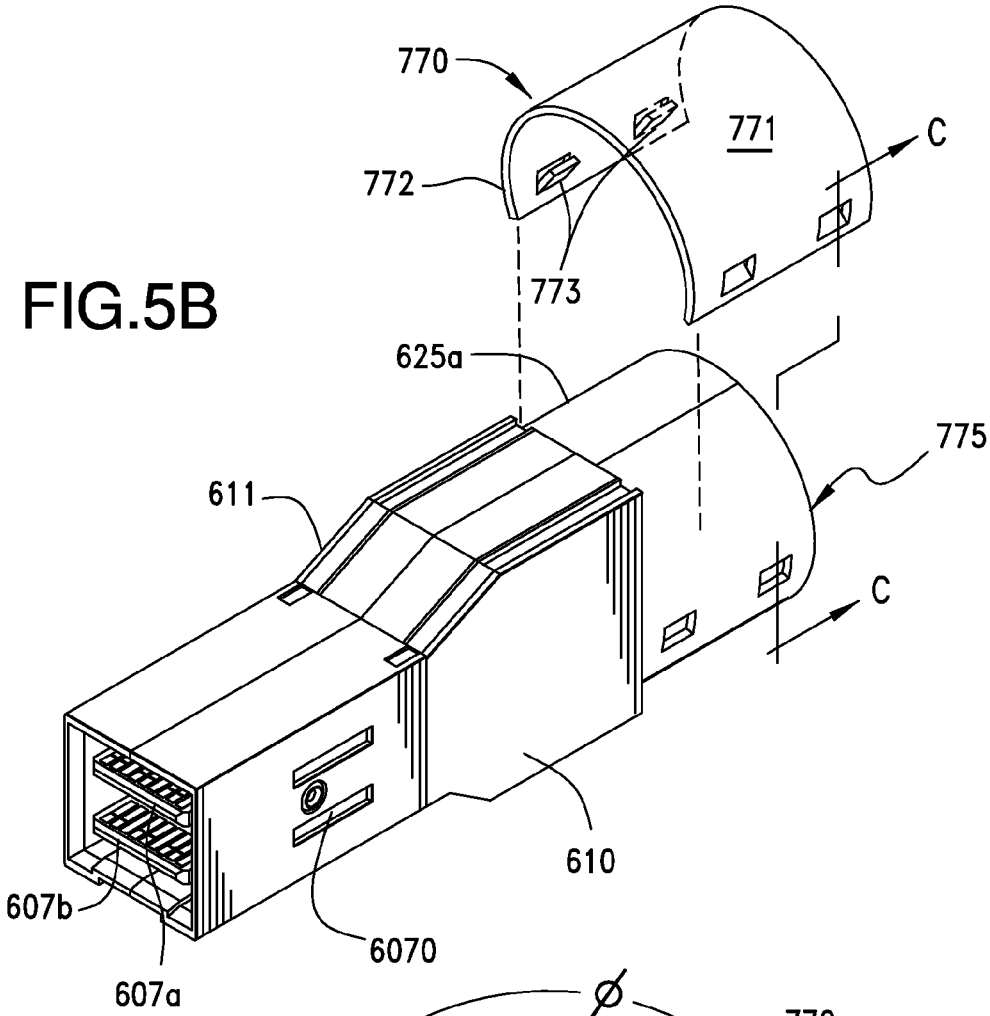
FIG. 5B is a perspective view of another embodiment of a retainer which has a general C-shape, with two free ends.
Figure 5C:
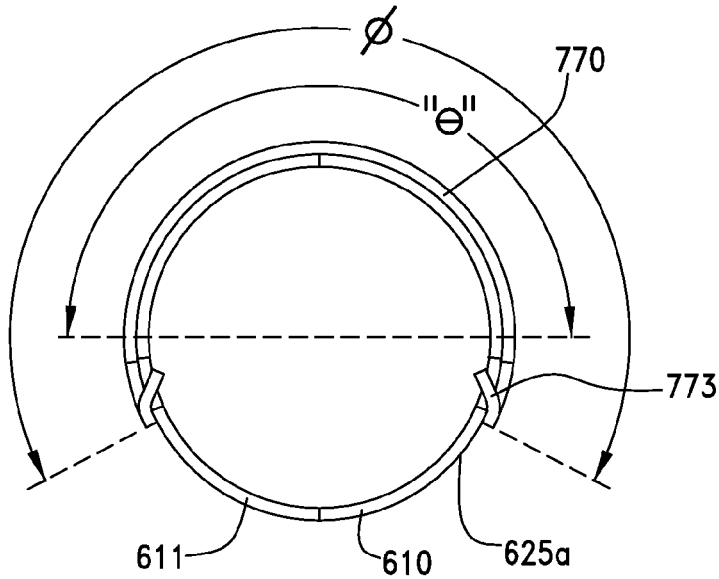
FIG. 5C is a sectional view of FIG. 5B, taken along lines C-C thereof.

Other retainers may also have a more rounded C-shaped configuration, rather than the rectangular and U-shaped configurations illustrated. As illustrated in FIGS. 5B and 5C, the retainer 720 can have a semi-circular or general C-shape with a backbone portion 771 from which extends two arm portions that terminate in free ends 772. These free ends 772 include engagement members shown in the form of tabs 773 that are punched, or otherwise formed, in the collar 770. In this alternate embodiment, the rear end 775 of the connector housing body portion 604 may be cylindrical and include a channel 625 in which the retainer 770 is received. The retainer 770 engages the part of circumference of the connector housing 601, i.e. its outer perimeter, and in order to apply a retaining face to the connector housing halves 610, 611, the arc length "ϕ" of it (or its length of engagement from one free end to the other) should be greater than 180° (or a majority of the outer perimeter) as shown diagrammatically in FIG. 5C. One can see the extent to which the free ends 772 extend past the halfway point, represented by "θ" in FIG. 5C.

As depicted, the connector housing body portion includes a channel (or recess) 625 that extends around the perimeter of the body portion to define a channel that receives the retainer 700. The channel 625 can have a depth sufficient to allow the retainer to be flush with respect to the connector housing outer surface(s) so as to maintain the desired size of the connector.

The first fastener can be seen to apply a linear fastening force horizontally along the lines F1 in FIG. 1, while the second fastener applies a circumferential force along the lines F2, but also preferably applies a fastening force in the vertical direction or along the lines F2 in FIG. 1.

The collar portion 608*g* may have engagement tabs 614*a*, formed therein, such as by stamping. These engagement tabs 614*a* are preferably formed as illustrated, on opposing extents of the retaining collar and four such tabs 614*a* are illustrated disposed proximate to corners of the retaining collar. Although illustrated as formed in the vertical wall portions thereof. The engagement tabs 614*a* may also be formed in the horizontal wall portions thereof.

Figure 4:
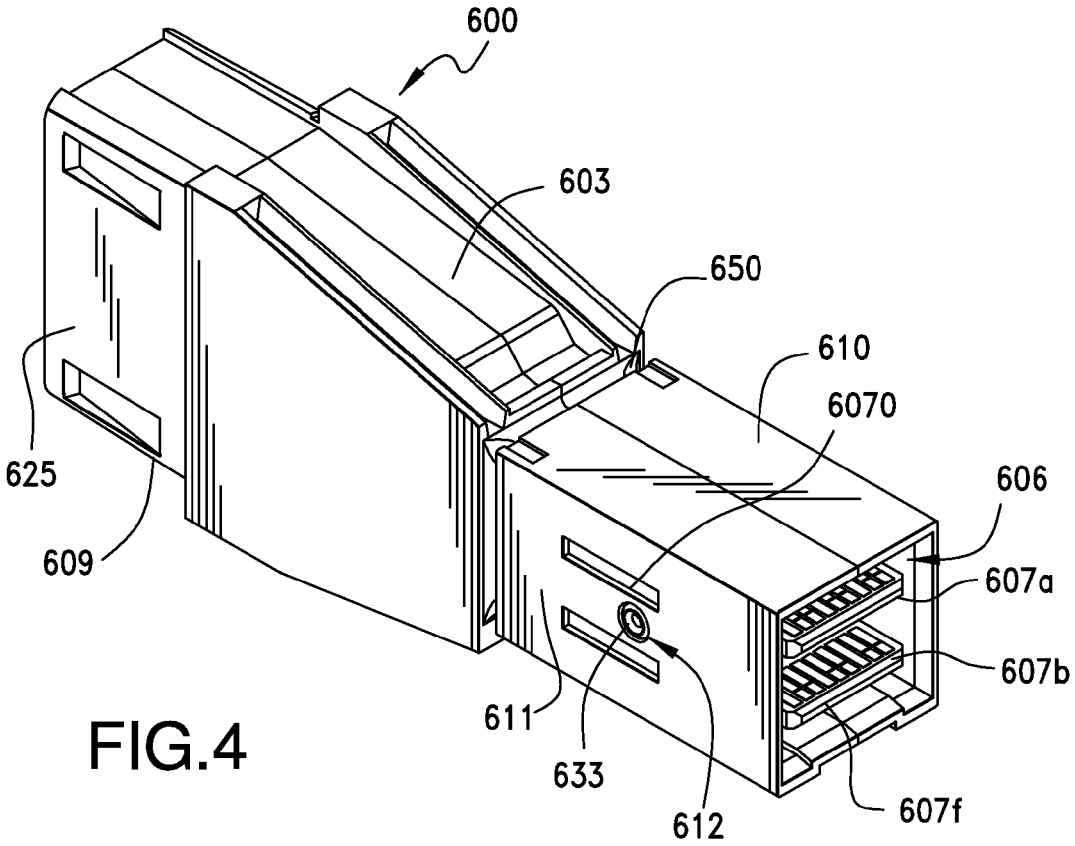
FIG. 4 is the same view as FIG. 3, but with the latching assembly, actuator and cables removed for clarity.

The engagement tabs 614*a* assist in retaining the collar 621 on the connector housing body portion 604. The connector housing body portion 604 includes a plurality of recess, or slots 614*b* that are formed in the outer surface thereof and these recesses correspond in number to the slot of the engagement tabs 614*a* such that a single engagement tab is received in a single recess 614*b*. The recesses 614*b* have shoulders 618 that serve as stop surfaces against which the engagement tab free ends 619 bear. This confronting relationship serves to retain the collar in place within the channel proximate to the end of the body portion 604. As shown in FIG. 4, the recesses 604*b* may have a variable depth, which increases toward the rear of the recess at the shoulder 618. This interference retains the collar in place on the connector housing and prevents it from being disengaged when the connector is connected or disconnected from a device. In this regard, the rear retainer 620 may be considered as affixed to the connector housing in as much as to remove it, one would need to pry it off or apart.

Figure 2:
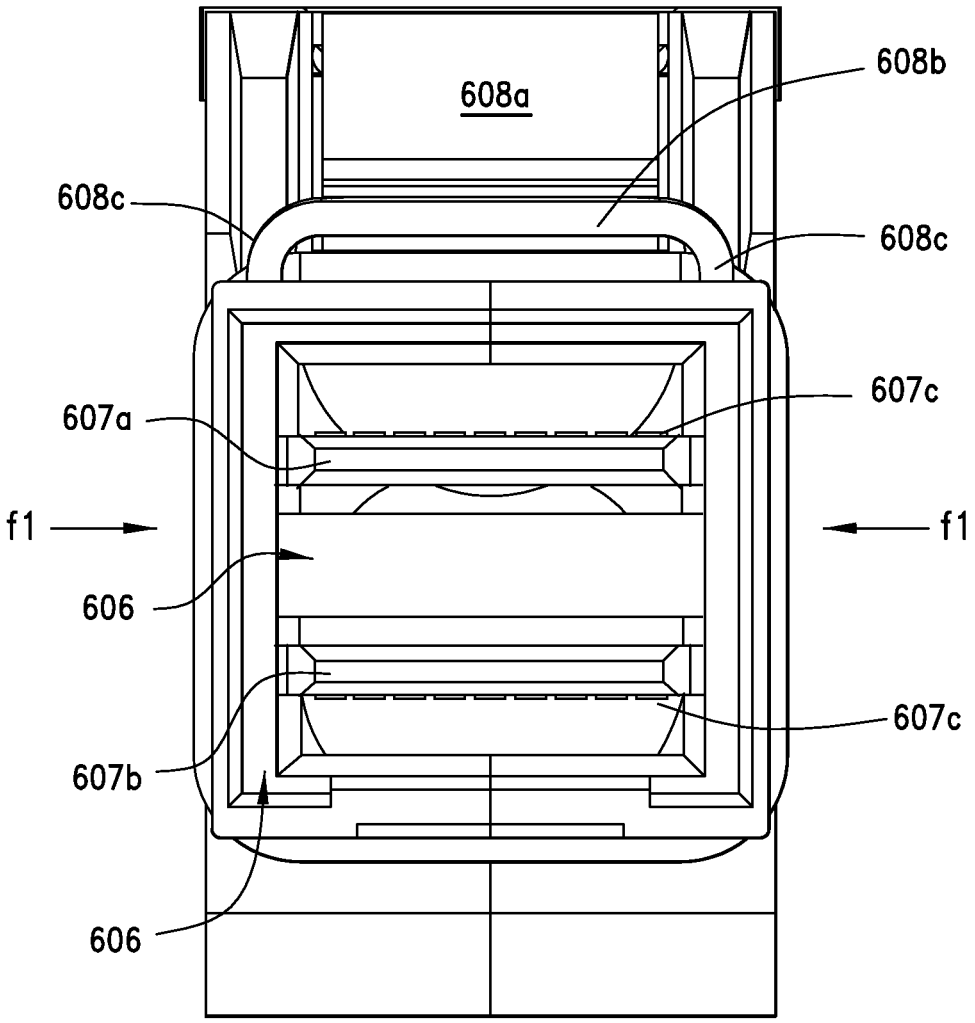
FIG. 2 is a front elevational view of the connector of FIG. 1.
Figure 3:
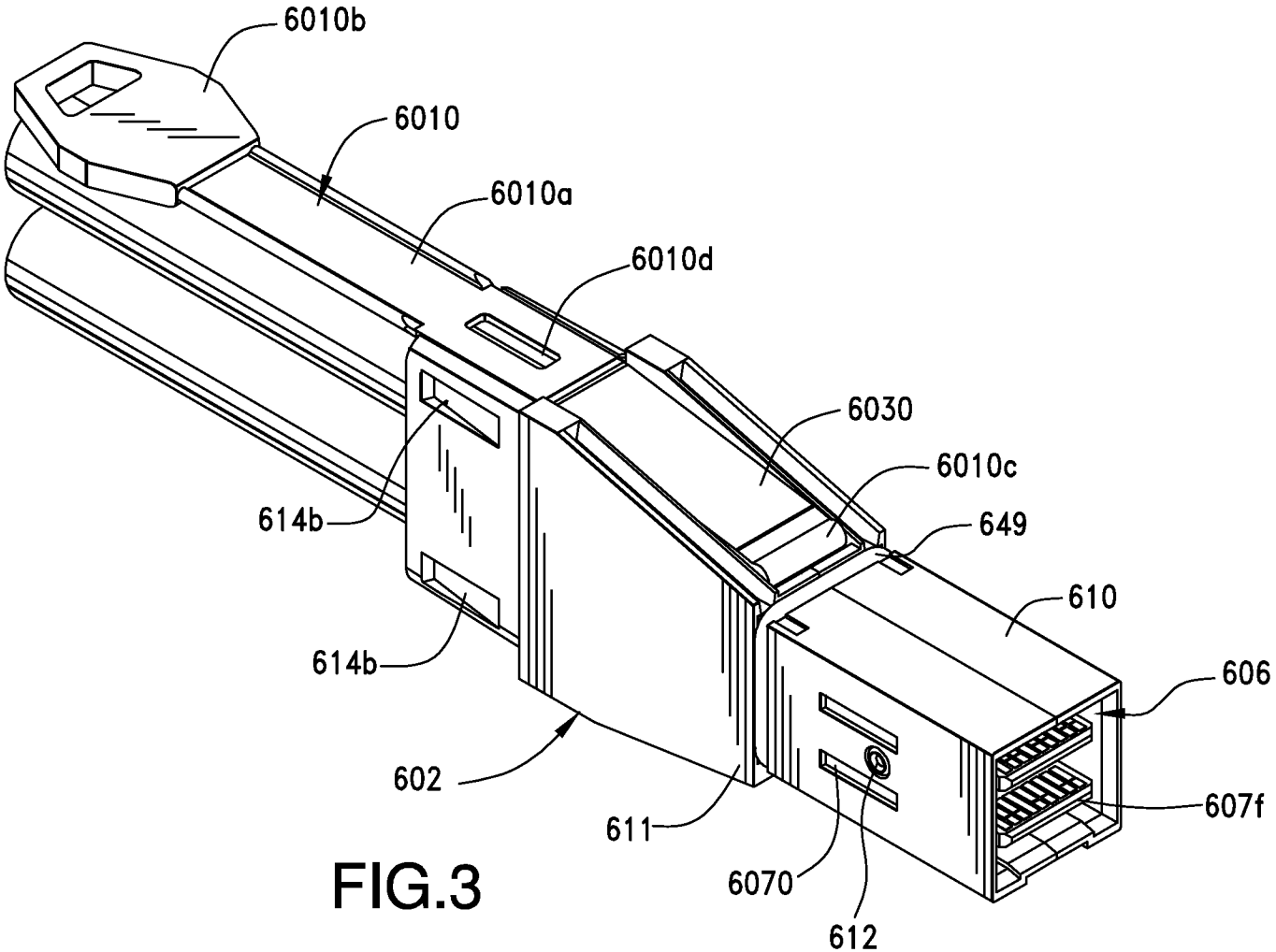
FIG. 3 is the same view as FIG. 1 but with the latching assembly removed for clarity.

As shown in FIGS. 1-3, the connector 600 also may include a manipulatable latching member 608 that has a longitudinal latching arm 608*a* that terminates in a free end 608*b* with a pair of latching hooks 608*c* disposed thereon and spaced apart from each other in the widthwise direction. The general structure of such a latching member are shown in U.S. Pat. No. 7,281,937, issued Oct. 16, 2007, owned by the assignee of the present application and hereby incorporated in its entirety by reference. These latching hooks 608*c* are received in corresponding openings formed in the housing of an opposing mating connector (not shown). The latching arm 608*a* extends longitudinally of the connector body portion 604 and preferably along the top side thereof and has a given lengthwise extent 603. (FIG. 3.) An actuator 601 is provided for operation of the latch member and it has an elongated, longitudinal body portion 601*a* that has a pull or push tab 601*b* at one end thereof and a cam surface or member 601*c* at the opposite end thereof. The actuator body portion 601*a* may include a guide that serves at least to partially retain the actuator 601 in place on the connector 600 and this guide is shown in the Figures as a slot 601*d* that engages a lug or the like formed on either the connector housing body portion 604, or as shown in the drawings, a lug 608*e* that is formed on the latching member 608 on the collar portion 621 thereof.

Figure 7:
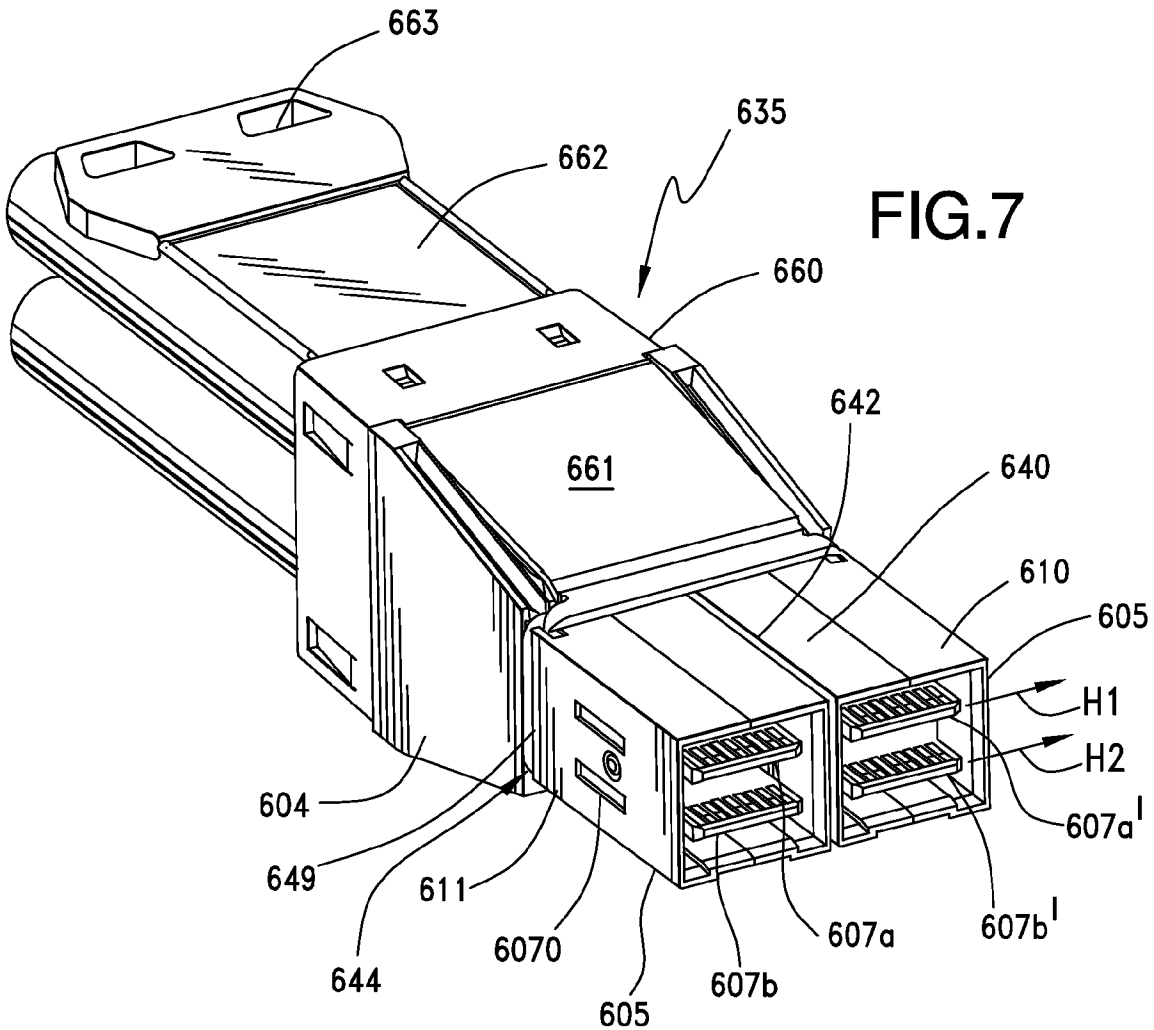
FIG. 7 is a perspective view of a tandem connector constructed in accordance with the principles of the present invention.
Figure 8:
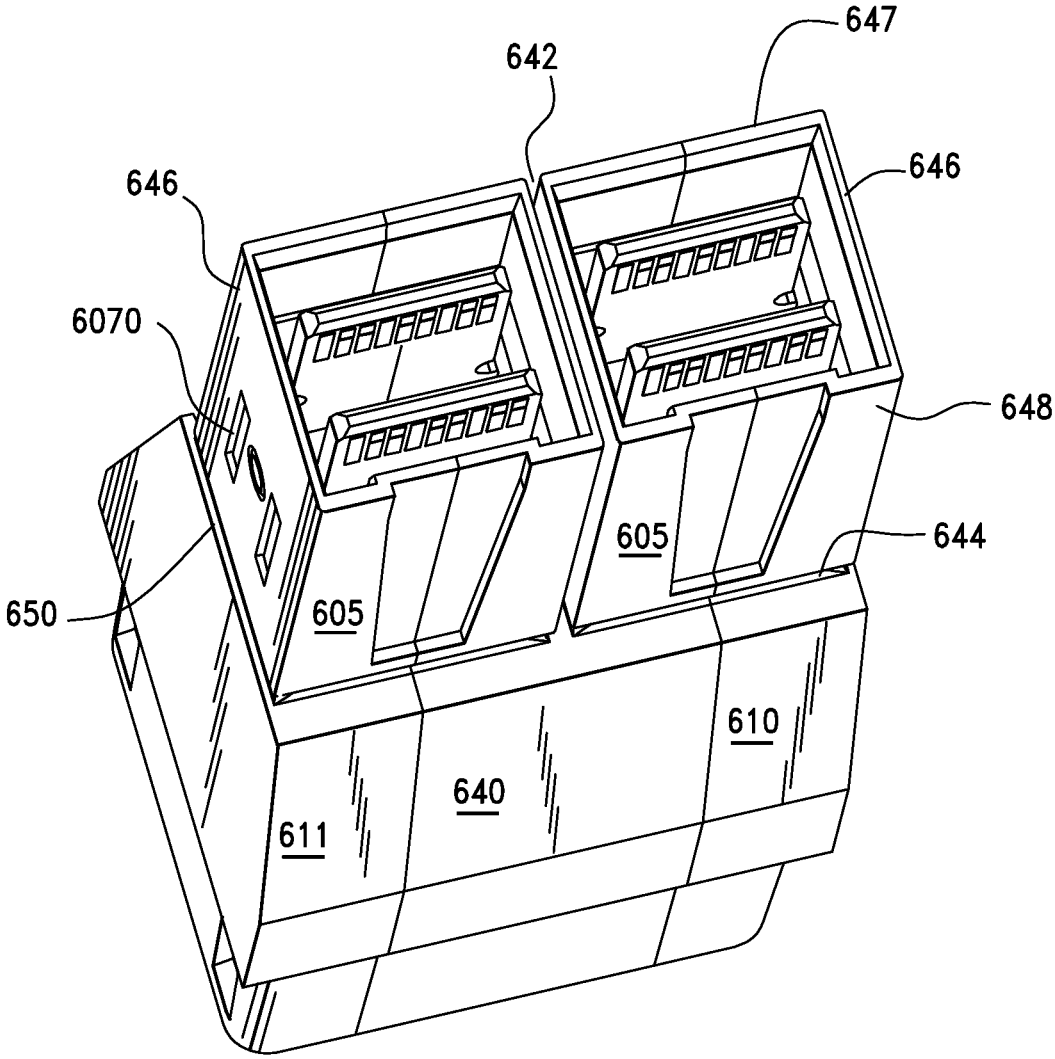
FIG. 8 is a perspective view of the connector of FIG. 7 taken from the front underside thereof.
Figure 9:
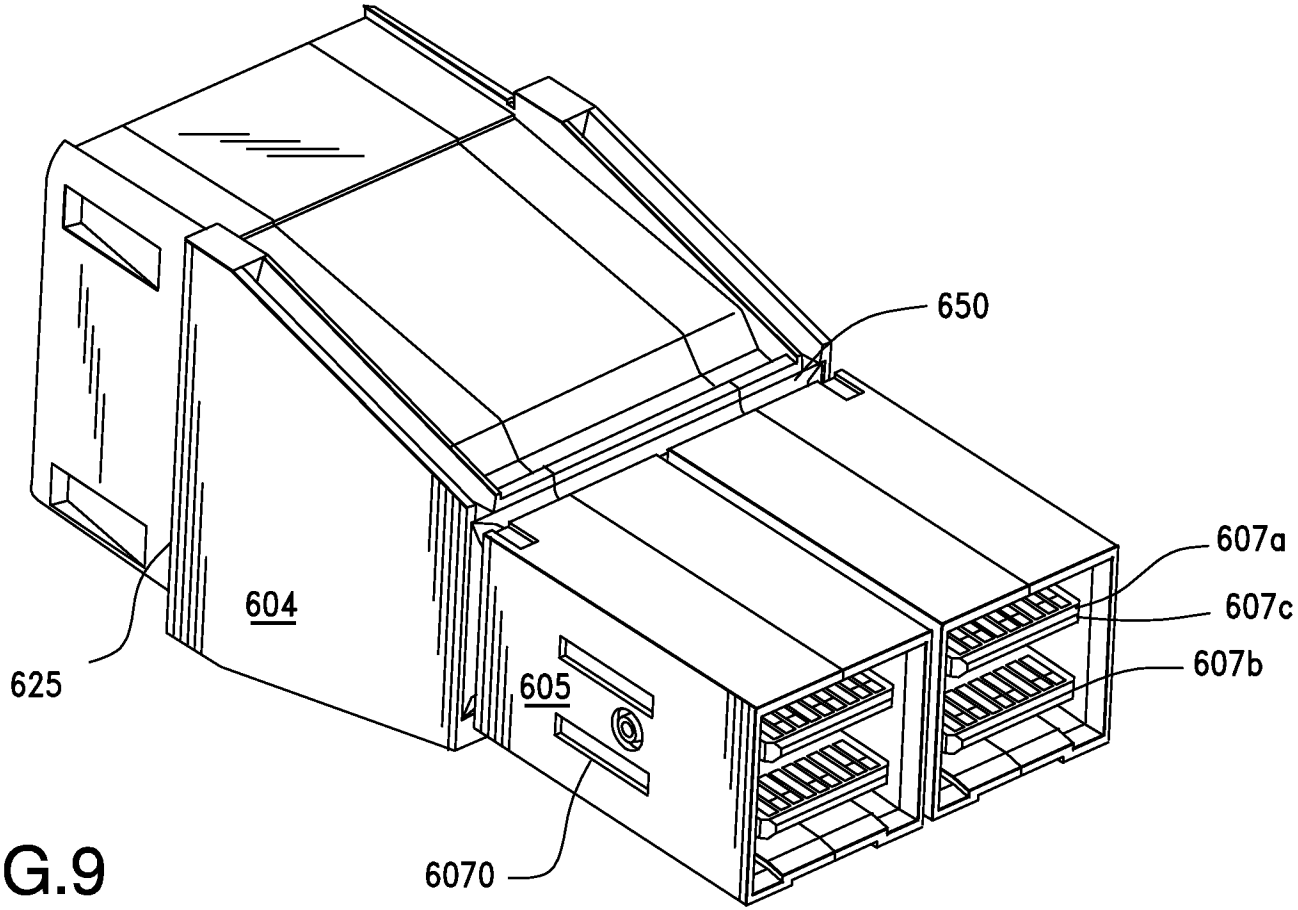
FIG. 9 is the same view as FIG. 7, but with the cables and latching collar removed for clarity.
Figure 10:
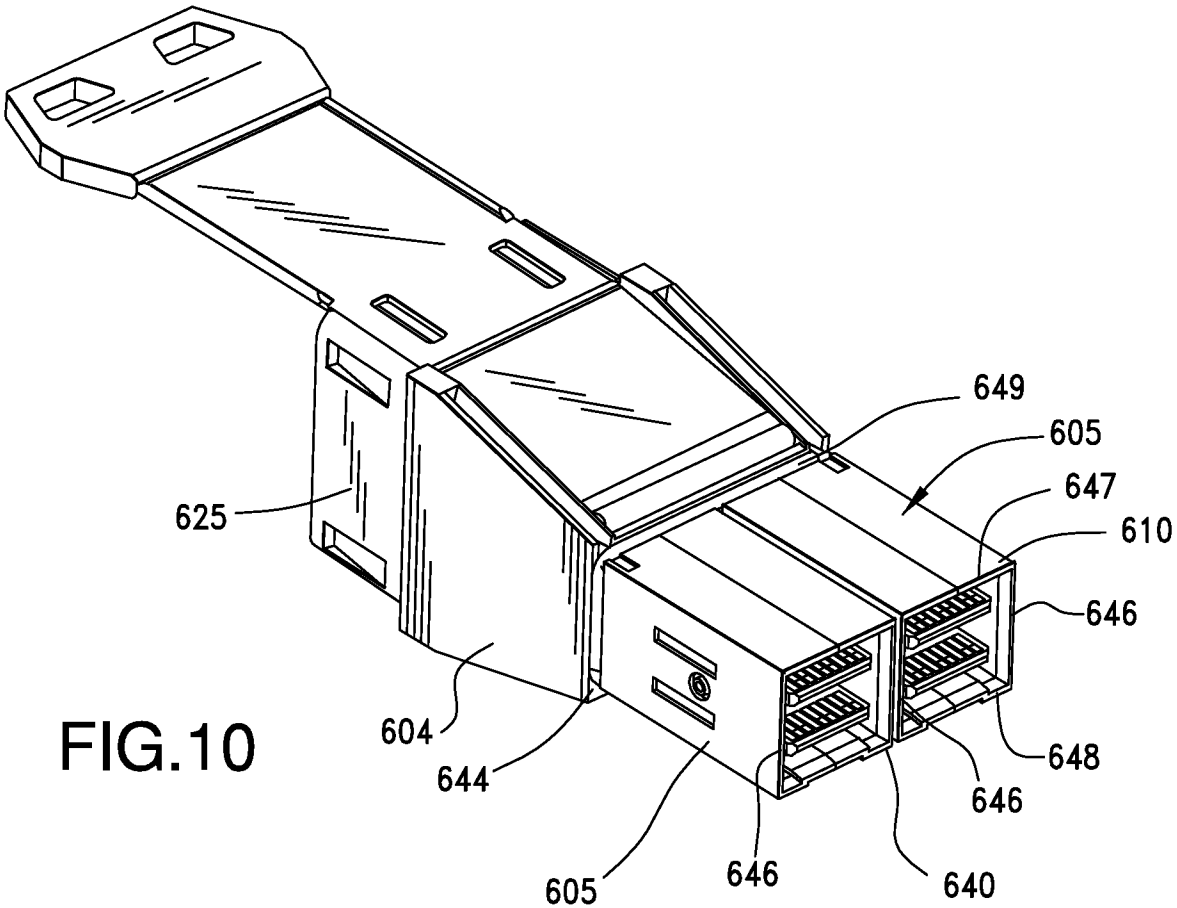
FIG. 10 is the same view of FIG. 9, but with the actuator illustrated in place upon the connector housing.

FIGS. 7-13 illustrate a tandem style connector 635. In this embodiment, a center piece 640 is provided and mates with the left and right housing halves 610, 611 to increase the size of the connector, widthwise and to provide a pair of hollow mating portions 605 that extend out from the body portion 604. Each mating portion 605 contains a pair of circuit cards 607*a*, 607*b*, 607*a*' and 607*b*'. Not only is it preferred that the circuit cards in each pair be parallel (i.e. lie in parallel planes), but it is also preferred that the circuit ends of the two different pairs lie in respective planes (i.e. cards 607*a* and 607*a*' lie in a first horizontal plane H1, while cards 607*b* and 607*b*' lie in a second horizontal plane H2, as shown in FIG. 7), meaning the circuit cards of each pair lie in two different, parallel planes, while the corresponding circuit cards between each different pair are coincident with each other. The first and second horizontal plane preferably will be sufficiently parallel to each other so that they can readily mate to an opposing connector.

Figure 17:
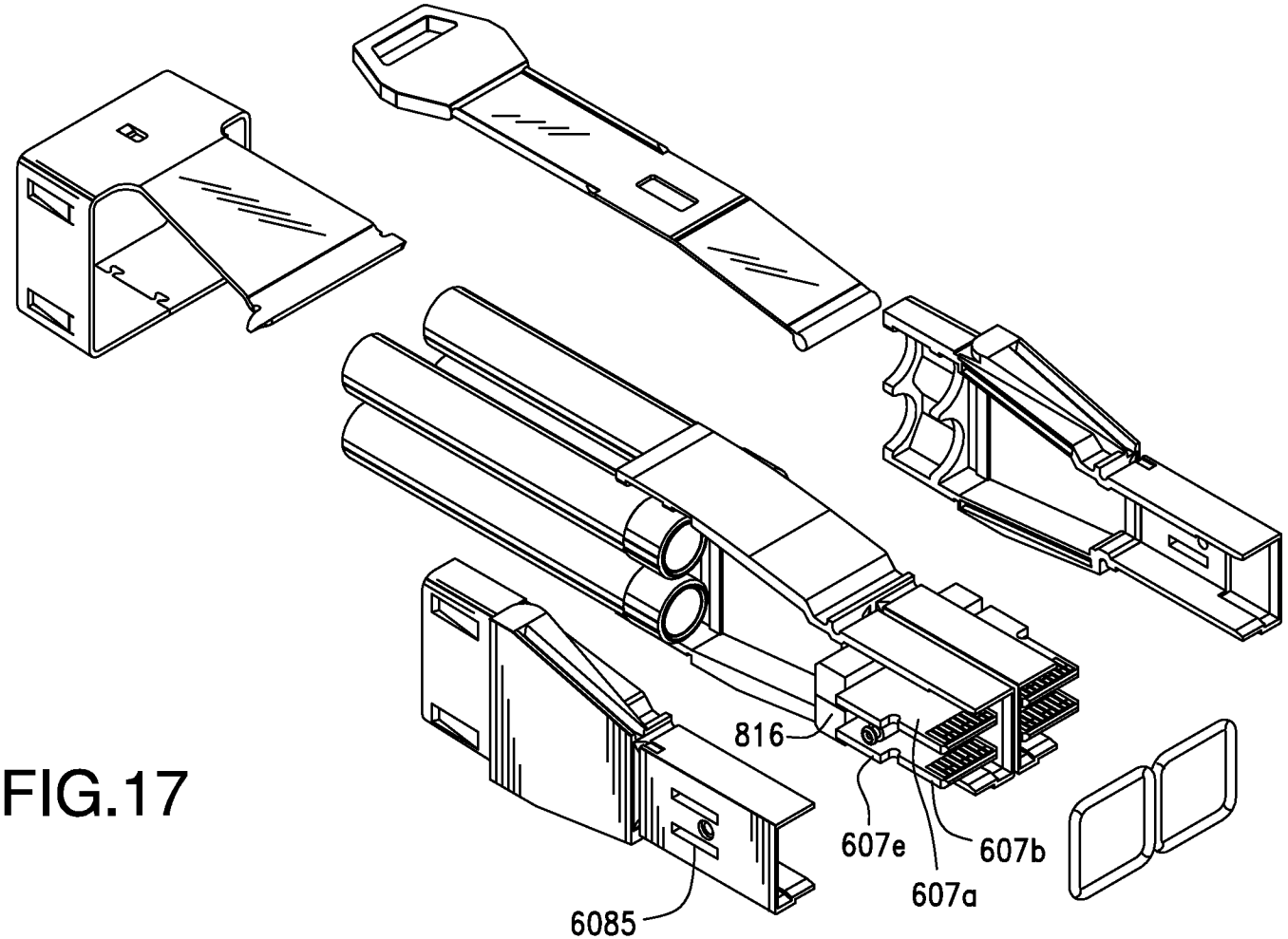
FIG. 17 is the same view as FIG. 15, but with the left and right housing and gaskets removed for clarity.
Figure 18:
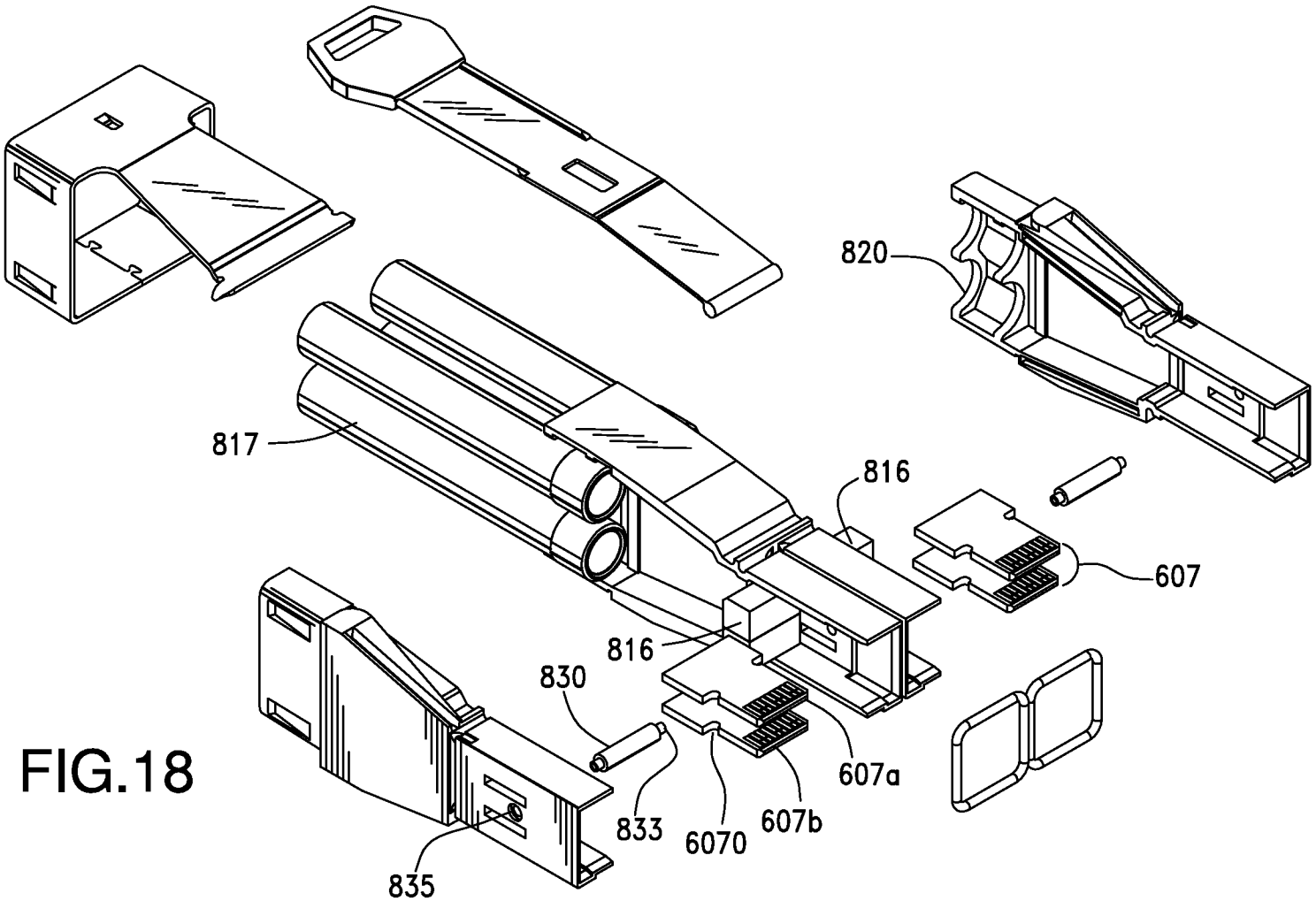
FIG. 18 is the same view as FIG. 17, but with the internal components removed for clarity.

The two mating portions 605 are separated by a slot 642 that extends rearwardly from the front edges thereof to the front wall 644 of the body portion 604. This slot 642 permits both mating portions 605 to be hollow enclosures, with sidewalls 646 and top and bottom walls 647, 648, respectively, but it also serves other purposes. For example, it can engage a dividing wall separating the two opposing receptacle connectors to which the connector 640 mates, and it also provides a channel that receives portions of either a pair of EMI gaskets 649 (FIG. 17) or a two-hole single gasket (not shown). Still further, it provides a slot opposing the free end 6323 of the front fastening posts 630, into which a plate can be inserted to act as a reaction surface when swaging the front fastener lugs 631 so that the swaging process does not cause the fastening posts to break through the inner sidewalls 646 of the center piece 640. The center slot 642 also communicates with a peripheral groove 650 that extends entirely around the mating portion(s) and which recesses the gasket 649.

The center piece 640 has opposing mating faces 645 (FIG. 11) that abut against contacting surfaces of the two housing halves 610, 611. The connector housing may be provided with a rear bulkhead 652 that has a plurality of cable support walls 651, each of which contains grooves 653 that are provided to grip the cables 615 and hold them in the desired vertical orientation. The walls 651 can be spaced apart from each other to provide measure of strain relief to the cables 615. The use of multiple grooves effectively splits the interior cavity 602 into two equal areas for the cable wires 616 to run to the circuit cards 607*a*, 607*b*. Inasmuch as the cable wires 616 are much smaller than the cables 615 and are spread out when mounted to the circuit card, the trapezoidal configuration of the interior cavity provides sufficient interior space for the wires and circuit cards where needed while still preserving the overall small size of the connector.

Figure 14:
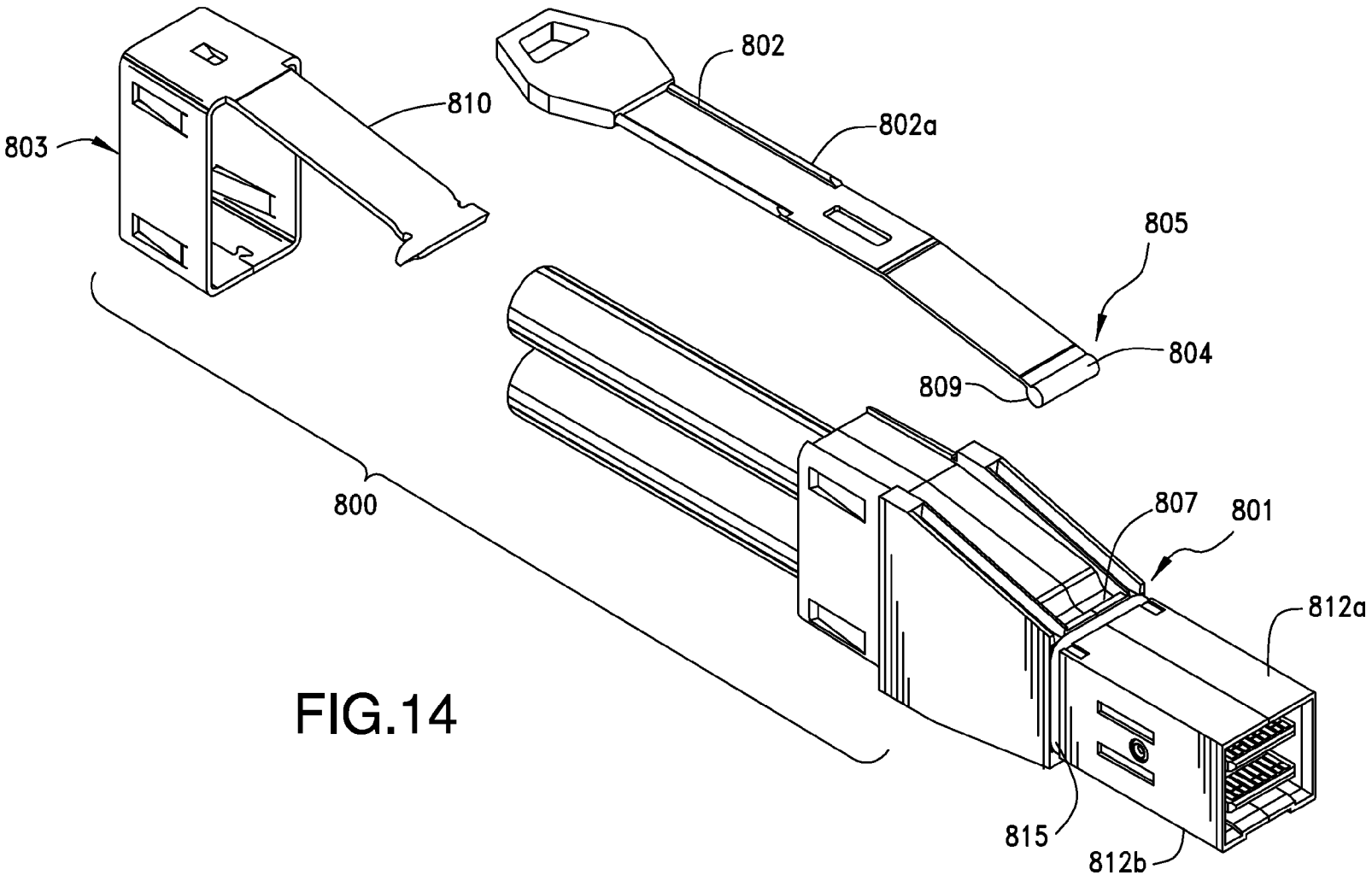
FIG. 14 is a partially exploded view of the connector of FIG. 1, better illustrating the structure of the actuator and the connector housing.
Figure 15:
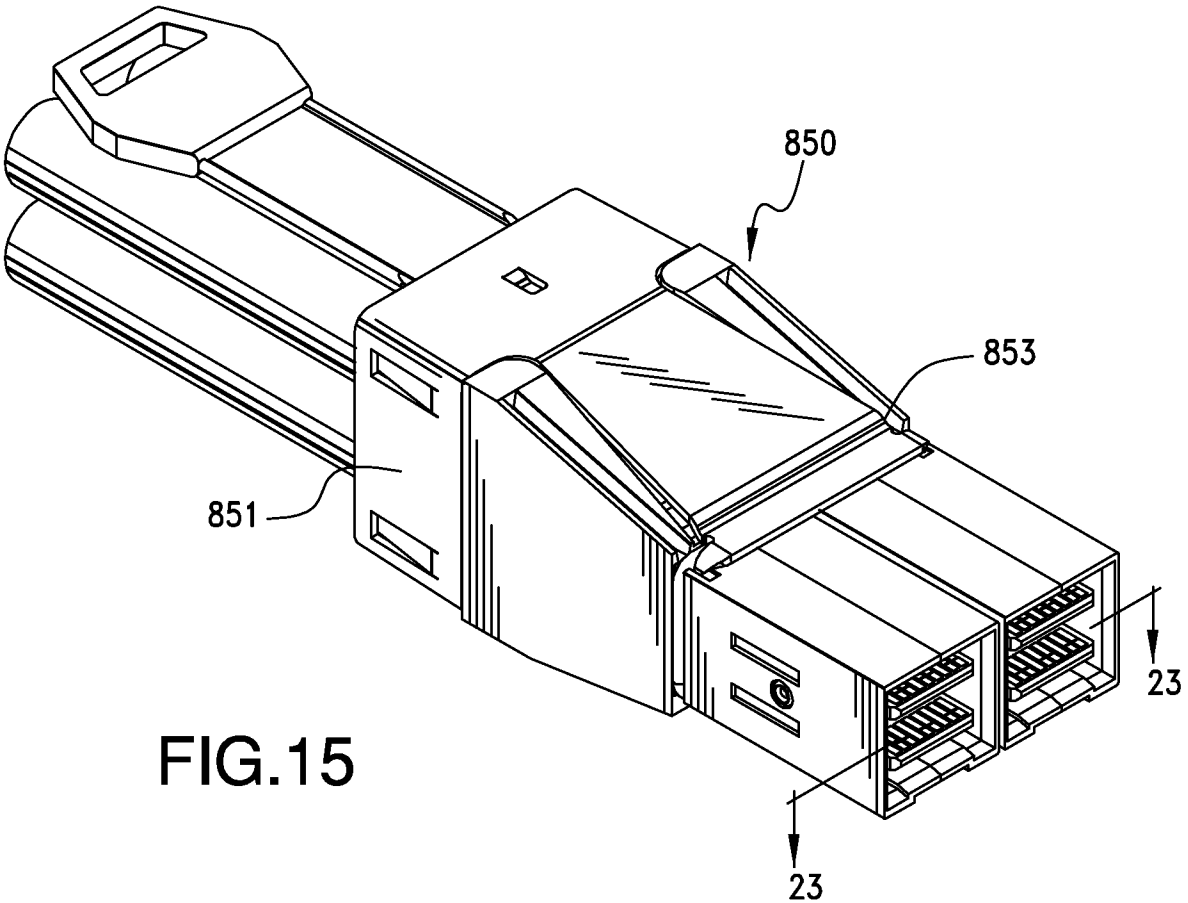
FIG. 15 is a perspective view of another embodiment of a tandem connector.
Figure 16:
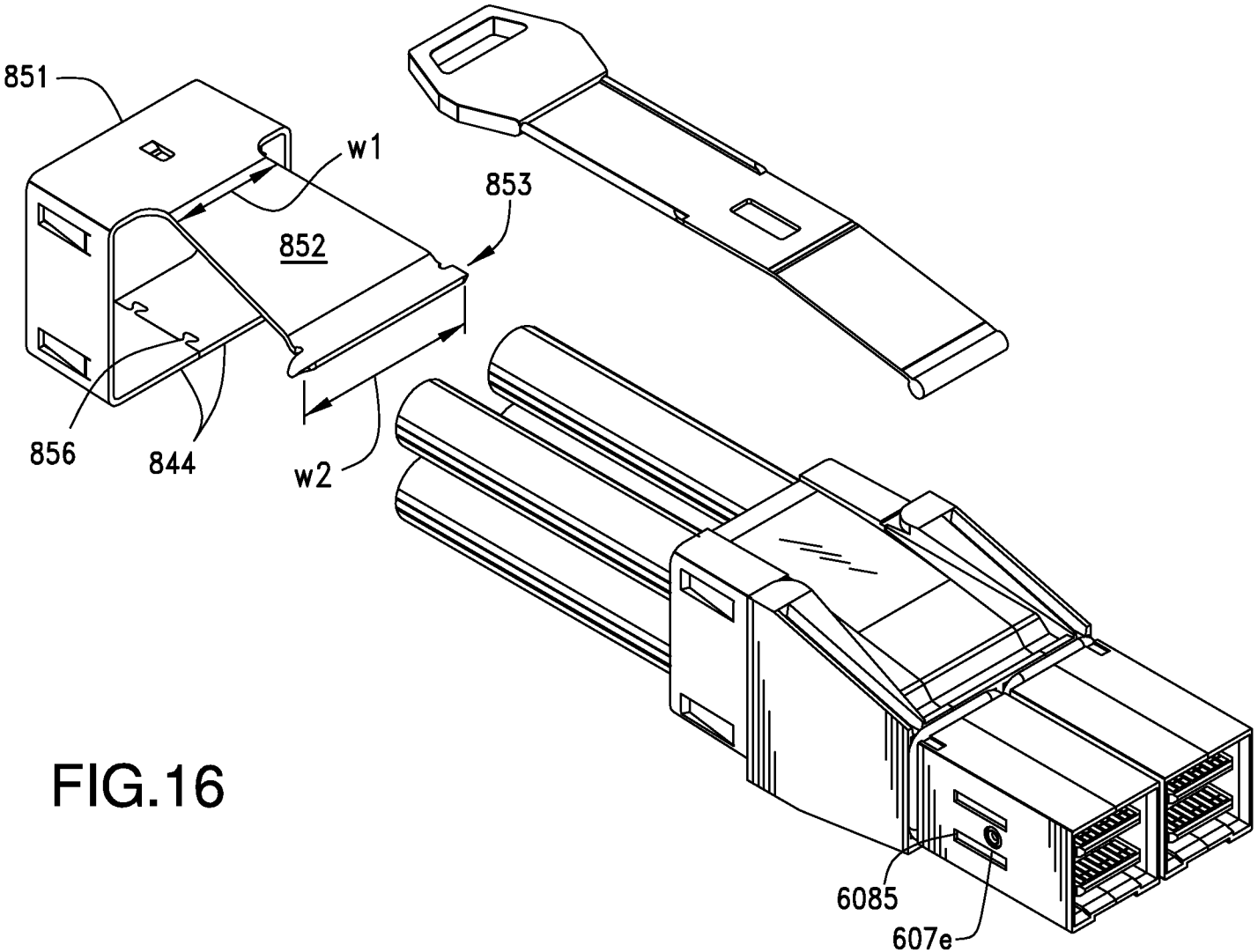
FIG. 16 is the same view as FIG. 15, but with the latching/fastening collar of actuator removed for clarity.

FIG. 14 illustrates an embodiment of a connector 800 that utilizes a connector housing 801, actuator 802 and latching assembly 803. As depicted, the actuator 802 has a pair of ribs 802*a* and a cam member 804 at its leading end 805 and the connector housing 801 has a recess 807 that receives the cam member 804. The cam member 804 is shown in the form of a cylindrical roll pin 809, although other shapes may be used. Both the actuator 802 and the latching collar latching arm 810 are received within a channel formed in the top of the connector housing 801.

The two housing halves 812*a*, 812*b* are joined together along a line that is coincident with the housing centerline, however it will be understood that the top and bottom portions of this mating line may be offset so as to provide another measure of interfitting. The housing 801 may include a grove similar to groove 650, discussed above, to receive an elastomeric, or other style, gasket 815 for EMI reduction. The housing may contain one or more interior blocks 816 (FIG. 17) that serve as stops for the circuit cards 607 or as premolded supports for free ends of the wires (not shown) exiting the cables 817. This embodiment also utilizes a pair of fastening posts 830 with opposing ends, and each with a swaging lug 833 disposed thereon. The posts 830 are inserted between the mating portion sidewalls of the connector 800 so that their lugs 833 extend through corresponding holes 835 in the sidewalls and then are swaged.

FIGS. 15-20 illustrate embodiments of a tandem connector 850. As can be appreciated from FIG. 16, a fastening clip 851 (which is depicted as a collar) includes a latching arm 852 with a varying width. The latching arm 852 has an expanding width in that its width changes from a first width $w_1$, at the top of the latching arm to a second width $w_2$ at its free end 853 as shown best in FIG. 16. The narrow upper part of the latching arm facilitates operation of the latching member and serves to reduce the pull or pushing force required to translate the latching arm. As can be appreciated from FIG. 16, the fastening clip 851 can be stamped and formed from a single sheet of metal. The stamped part has two free ends 854 that are joined together by a dovetail arrangement 856. The trailing edge of the housing 801 can be slotted and provided with a pairs of ribs 820 that are configured to grip the ends of the cable 817 so as to secure them in the housing.

As in the other tandem embodiment, the front fastener is shown interposed between the top and bottom circuit cards 607*a*, 607*b* and two such fasteners in the form of posts 830 are used to hold the housing halves together at the nose portion.

With this type of horizontal structure, cost of assembly as well as inventory of parts can be reduced. The right and left housing halves can be minor images of each other so that in order to assemble a multiple bay connector, only two sides and a center piece is required to form a two bay tandem-style connector. Additional bays may be added by using additional center pieces. For example, two center pieces and two side pieces can be combined to form a three bay connector. Additional center pieces can be used to expand the number of mating portions. In the depicted embodiment, the number of mating portions will always be one more than the number of center pieces.

Figure 19:
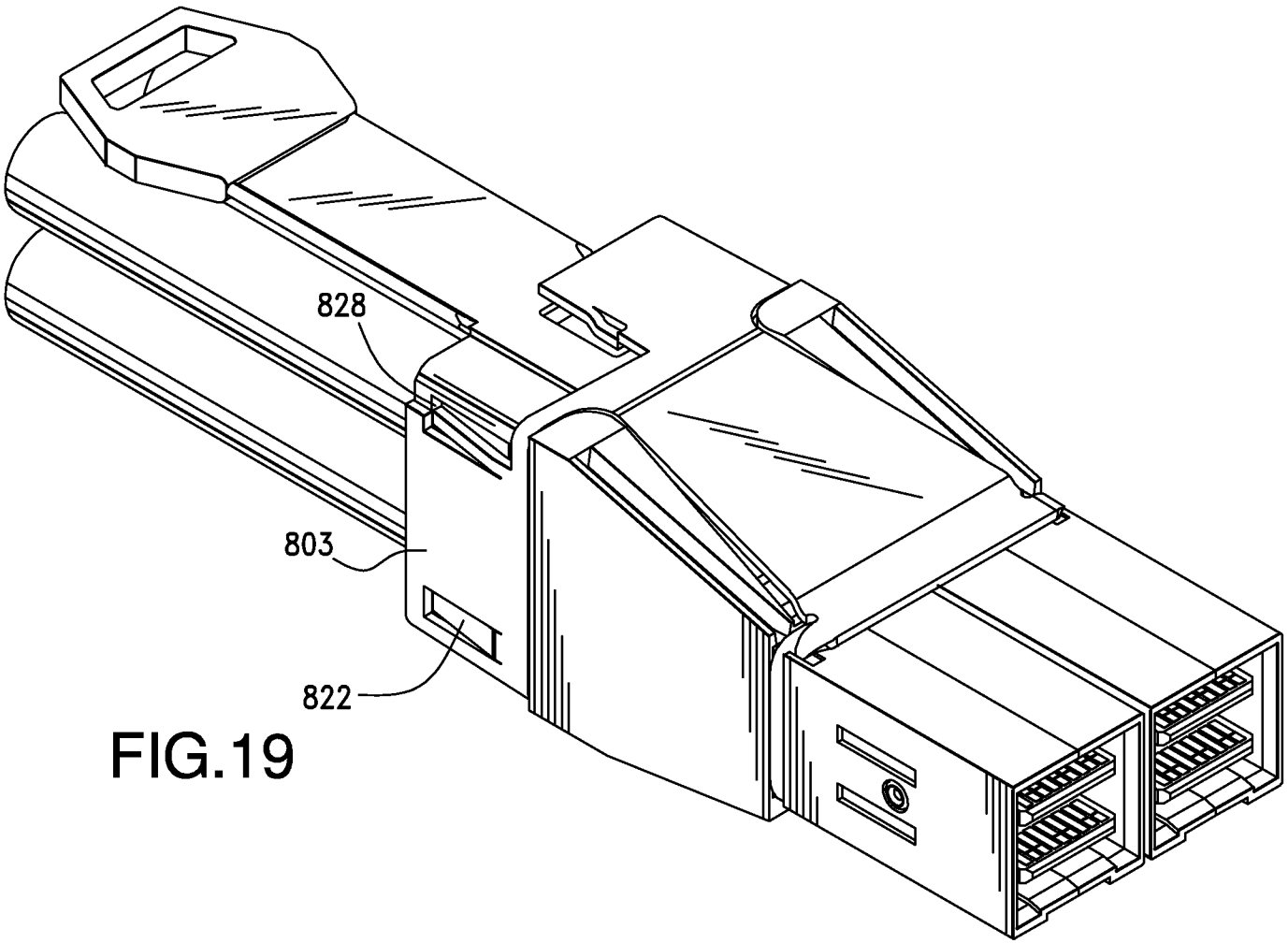
FIG. 19 is a view similar to FIG. 15 with a portion of the latching/fastening collar removed to illustrate its engagement with the actuator and connection housing body portion.
Figure 20:
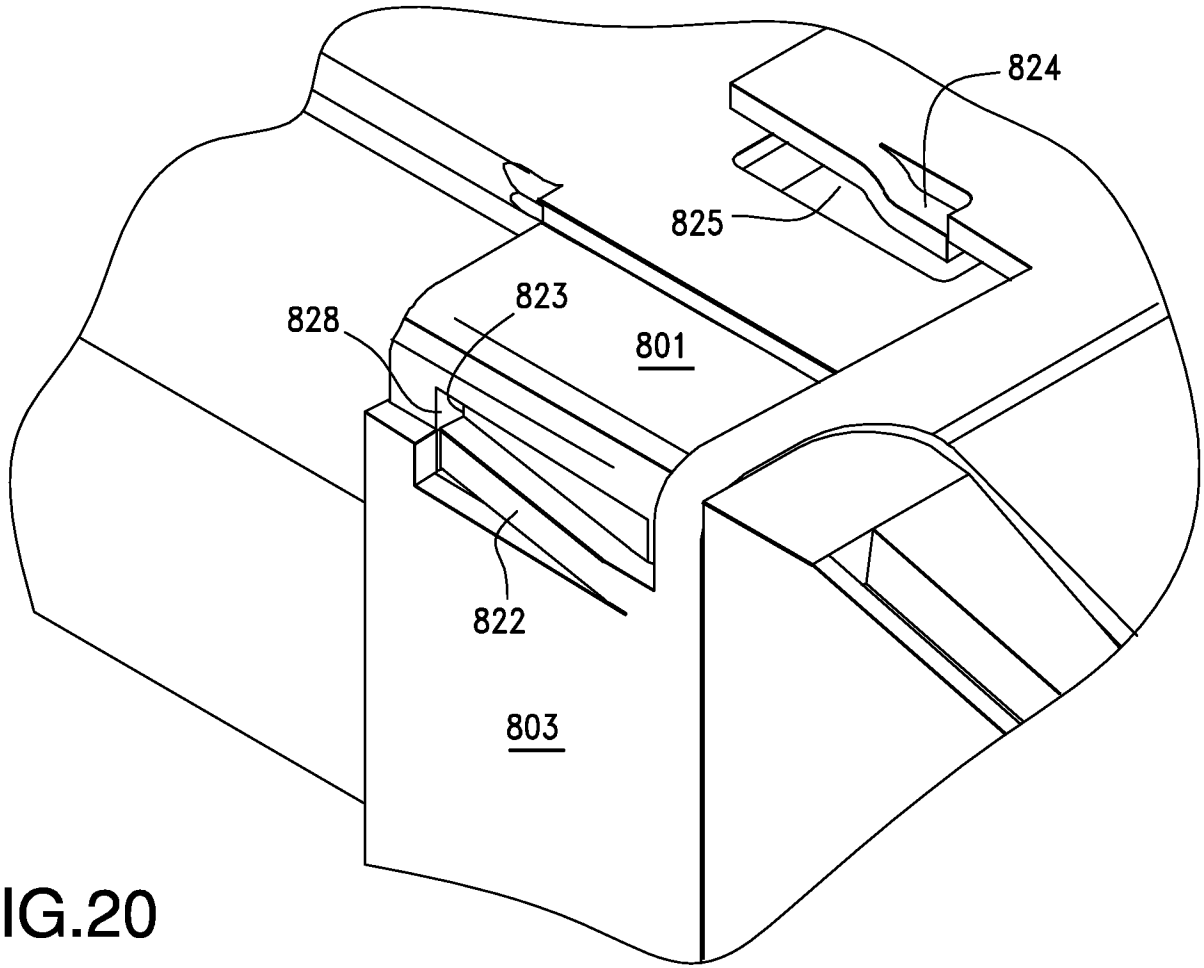
FIG. 20 is an enlarged detail view of the latching/fastening collar of FIG. 19.
Figure 21:
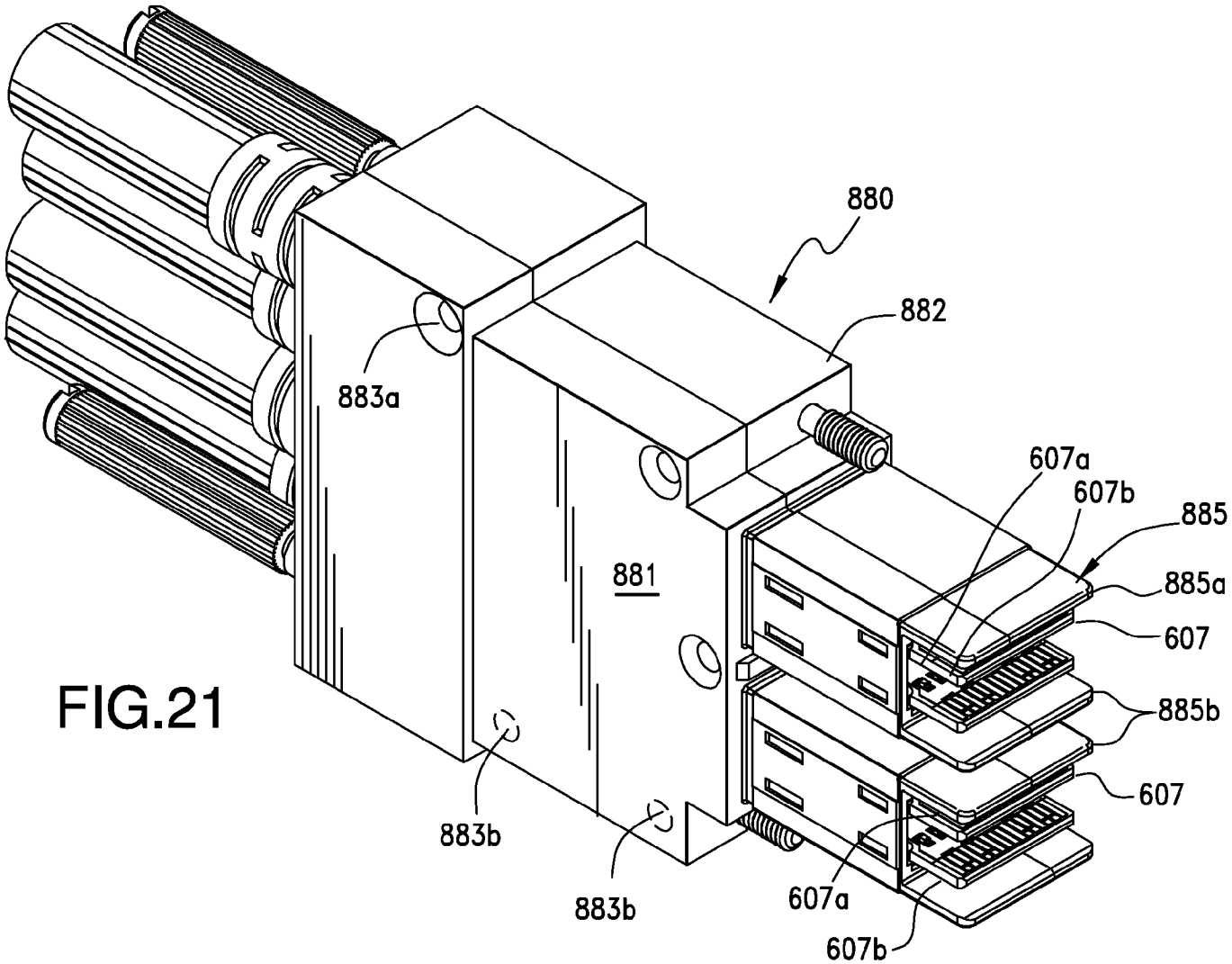
FIG. 21 is a perspective view of another embodiment of a connector.
Figure 22:
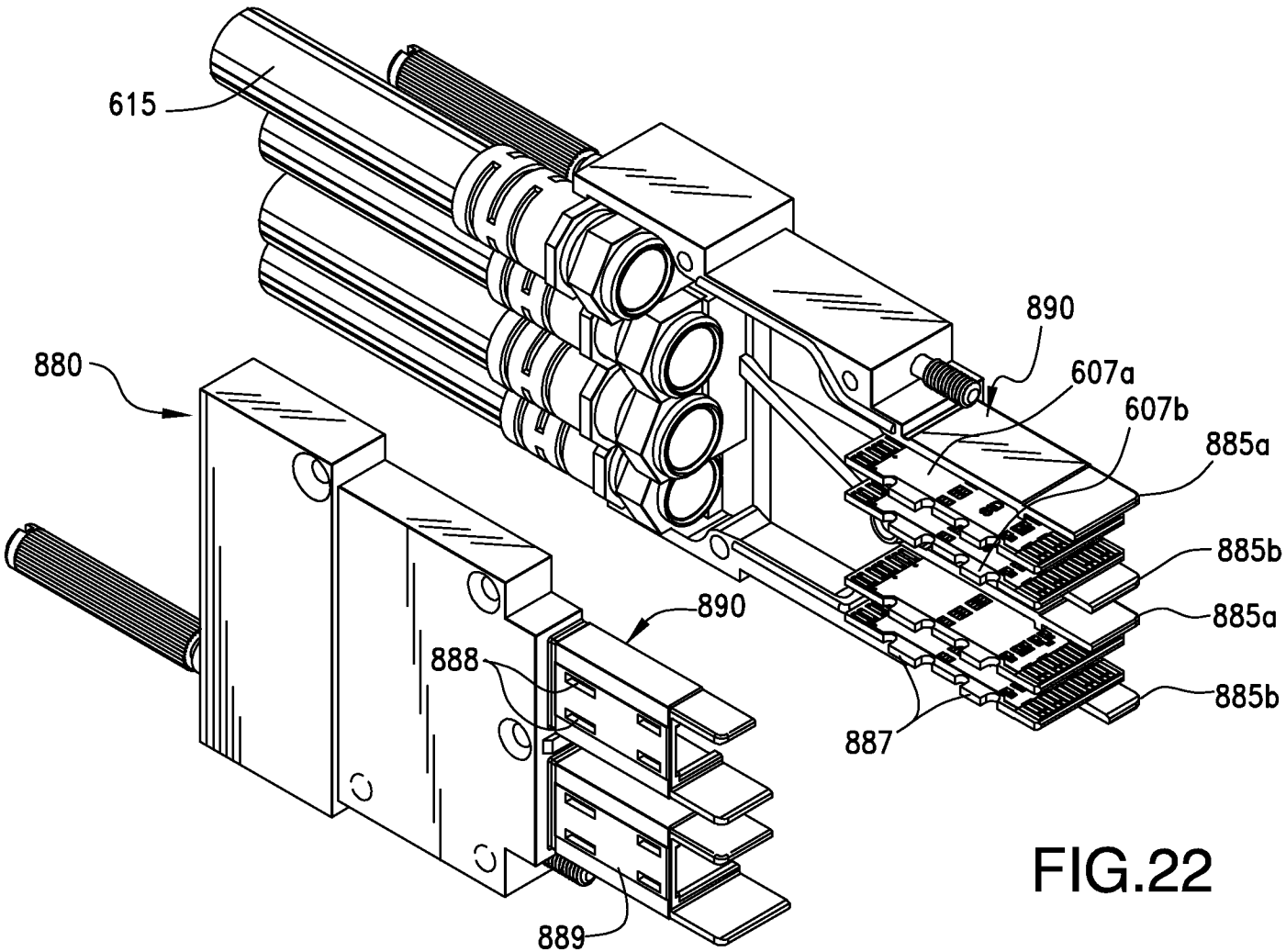
FIG. 22 is an exploded view of the connector of FIG. 21.
Figure 23:
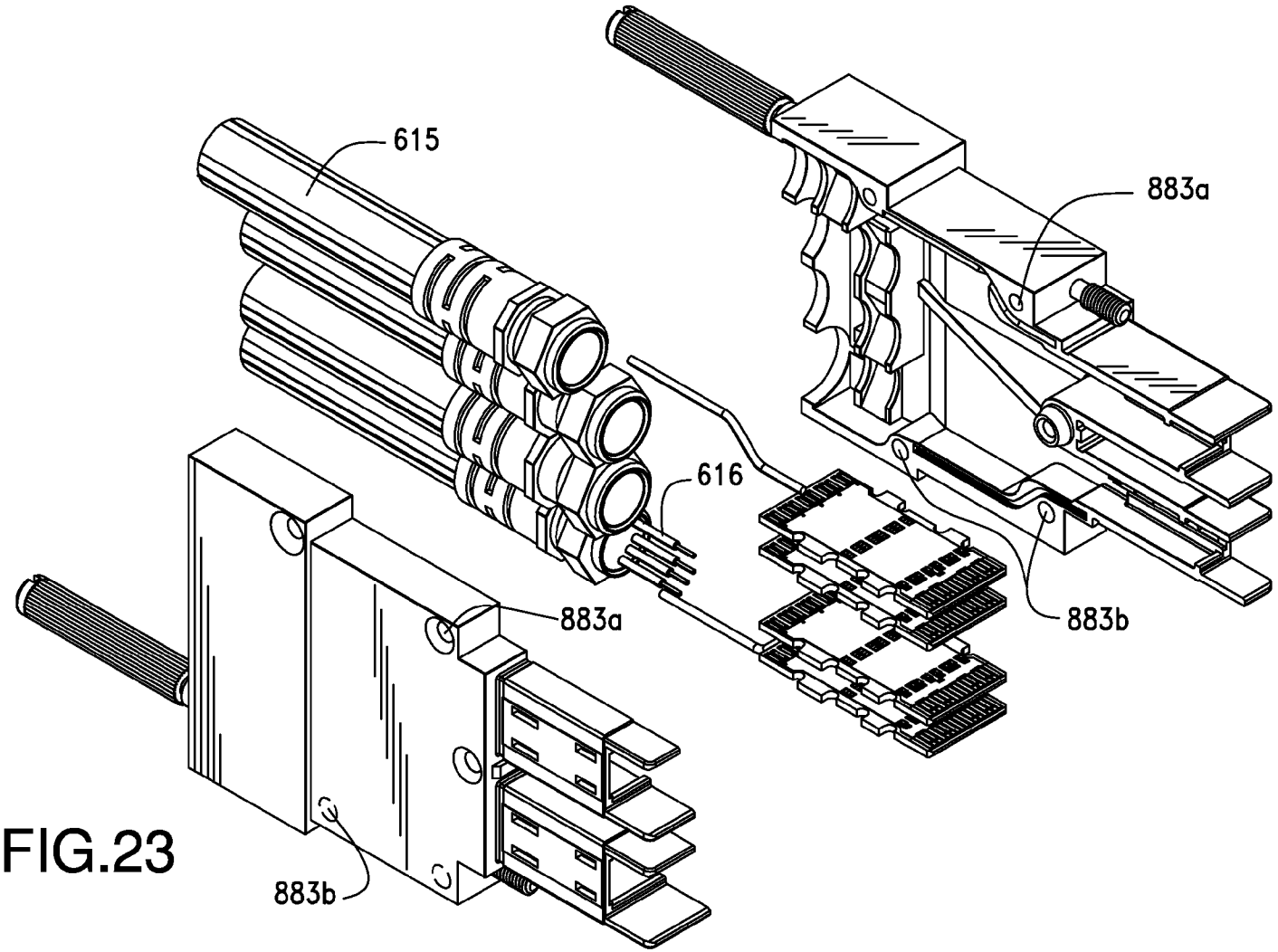
FIG. 23 is the same view as FIG. 22, but with the cables and circuit cards removed from the left hand housing for clarity.
Figure 24:
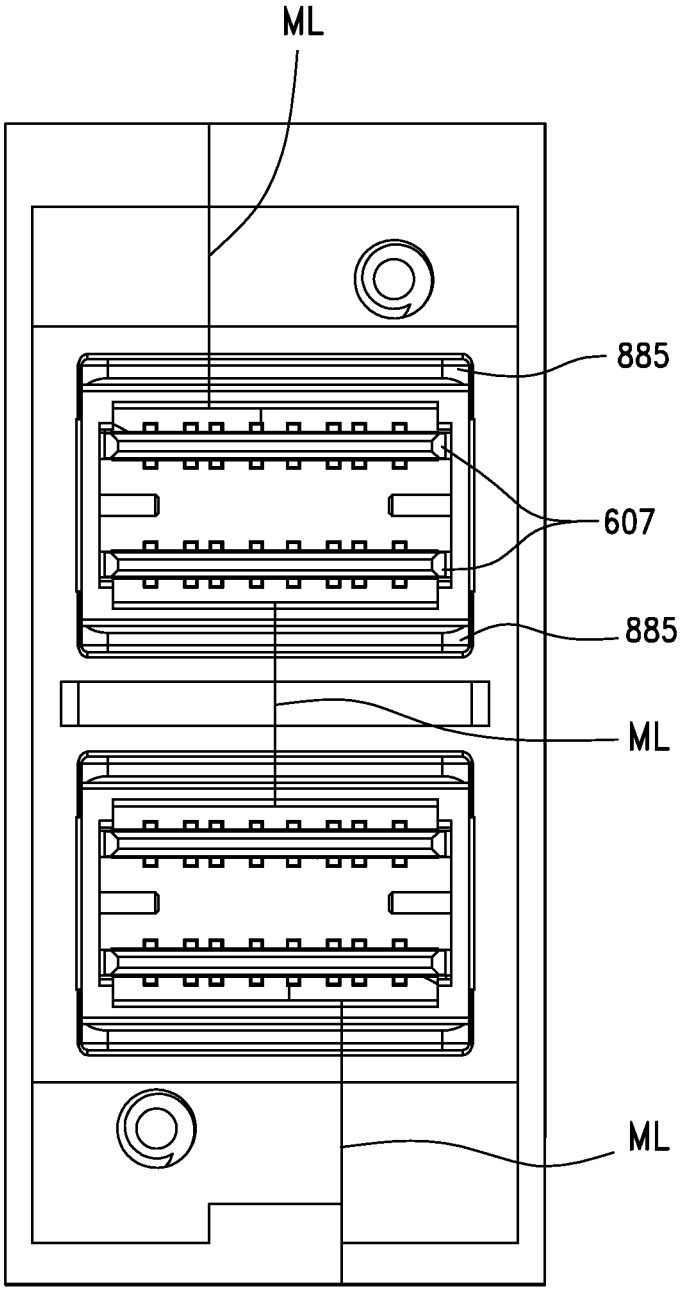
FIG. 24 is a front elevational view of the connector of FIG. 23.

As illustrated in FIGS. 19-20, the latching assembly retaining collar 851 can be punched, or stamped, to form engagement tabs 822 that are bent inwardly and which are received within corresponding slots 823 that are formed in the exterior surfaces of the connector housing 801 on the collar-mounting channel or recess 675 thereof. As depicted, the free end of each engagement tab 822 is seen to abut a wall, or shoulder 828 of the housing slot 823 and the tab 822 serves to retain the collar 803 in place upon the connector housing 801. Likewise, the collar 803 may have an additional tab 824 that is disposed in its top portion and which extends through a opening 825 disposed in the actuator so as to retain the actuator in place on the connector housing 801. In an embodiment, the collar 803 may also be dimensional slightly smaller or the same as the trailing edge of the connector housing 801 so as to provide a tight interference fit on the connector housing and exert a fastening pressure on the multiple pieces that make up the housing.

FIGS. 21-24 illustrate another embodiment of a connector 880 that has two sides, or housing halves 881, 882 that are fastened together by screws or similar fasteners in holes 883 that are arranged in a pattern that approximates the perimeter of the connector housing. The holes are provided in both of the two housing halves 881, 882 so that fasteners may be inserted in the holes 883*a* of the right housing half 881 and the holes 883*b* shown is phantom of the left housing half 882, so that an even, balanced fastening force is applied.

In this embodiment, the connector supports multiple pairs of circuit cards 607 in a vertical mating arrangement. The circuit cards 607*a*, 607*b* have leading edges that serve as mating projections for the connector and which are partly protected by pairs of flanges 805, a pair of flanges 805 being disposed on the tops and bottoms of each circuit card pair. The flanges 885 may be made so that they have different projecting lengths. In the embodiment shown, the top flange 885*a* is shorter than bottom flange 885*b* and this permits the lower flanges 885 of each pair of circuit cards 607 to serve as keys for mating with an opposing connector. In an embodiment, the key can be disposed on the bottom flange, either using the flange itself or by forming a recess, or ridge 900 as shown in FIGS. 1-6.

Figure 25:
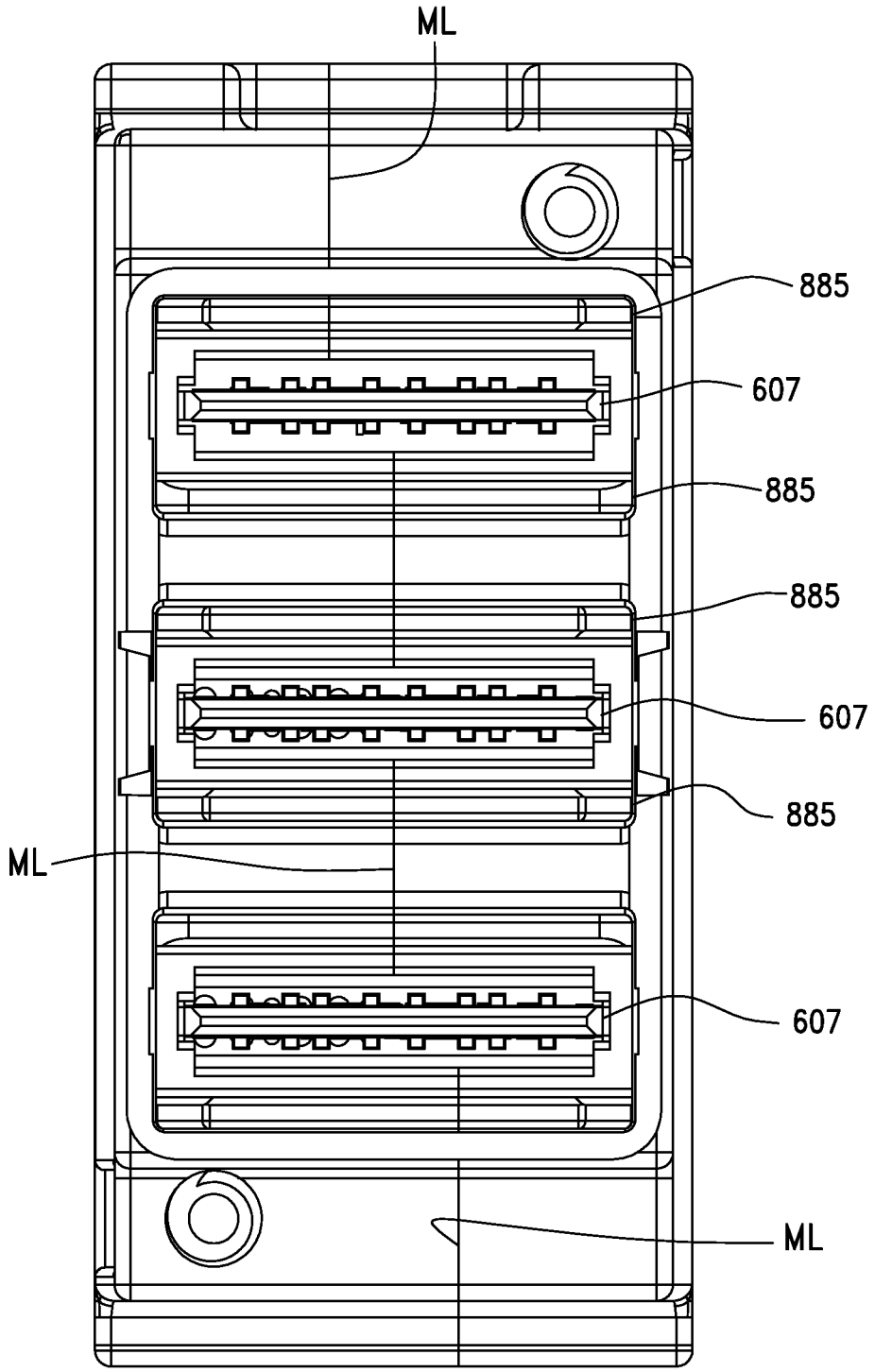
FIG. 25 is a front elevational view of another embodiment of a connector.

The circuit cards 607*a*, 607*b* of this embodiment also may include multiple wings 887 on each side of the circuit card that are received in slots 888 formed in the sidewalls 889 of the mating portions 890 of the connector 880. In this manner, the circuit cards of each pair of circuit cards may be orientated parallel to each other and parallel to the other pairs of circuit cards. FIG. 25 illustrates how three circuit cards 607 may be arranged in a vertical fashion between two flanges 885. Thus, as can be appreciated, a stacked connector with two or three or more pairs of circuit cards may be provided.

It will be understood that there are numerous modifications of the illustrated embodiments described above which will be readily apparent to one skilled in the art, such as many variations and modifications of the connector assembly and/or its components including combinations of features disclosed herein that are individually disclosed or claimed herein, explicitly including additional combinations of such features, or alternatively other types of contact array connectors. Also, there are many possible variations in the materials and configurations. These modifications and/or combinations fall within the art to which this invention relates and are intended to be within the scope of the claims, which follow. It is noted, as is conventional, the use of a singular element in a claim is intended to cover one or more of such an element.

What is claimed is:

1. A connector, comprising:

a housing with a body portion and a first mating portion, the first mating portion including a first and second sidewall separated in a horizontal direction by an intervening space, each of the first and second sidewall having two slots, each slot having two pair of opposing side wall portions;

a first and second mating blade horizontally positioned in the mating portion and being arranged in an vertical, spaced-apart manner, the first and second mating blade each including a body portion with a leading edge and a trailing edge, the trailing and leading edge interconnected by two side edges, the leading edge including a plurality of conductive contacts disposed therealong and the trailing edge including a plurality of termination contacts disposed therealong; and a wing portion extending from each of the side edges of the first and second mating blade, each wing portion engaging one of the slots.

2. The connector of claim 1, wherein the first circuit card wing portions engage the slots in both vertical and horizontal directions.

3. The connector of claim 1, wherein the first and second mating blade include reentrant portions at the intersection of the side edge with the wing portion.

4. The connector of claim 3, wherein the reentrant portions include notches.

5. The connector of claim 1, wherein the wings on opposing side edges of the mating blade are at least partially offset.

6. The connector of claim 1, wherein the mating blade has a first length and the wing portion has a second length, the second length being at least 33 percent of the first length.

7. The connector of claim 6, wherein the second length is between 33 percent and 50 percent of the first length.

8. The connector of claim 1, when the first and second mating blade has a T-shaped configuration.

9. The connector of claim 1, wherein each mating blade has a plurality of wings on each side of the mating blade.

10. A connector, comprising:

a housing with a body portion and a first mating portion, the first mating portion including a first and second sidewall separated in a horizontal direction by an intervening space, each of the first and second sidewall having two slots;

a first and second mating blade horizontally positioned in the mating portion and being arranged in an vertical, spaced-apart manner, the first and second mating blade each including a body portion with a leading edge and a trailing edge, the trailing and leading edge interconnected by two side edges, the leading edge including a plurality of conductive contacts disposed therealong and the trailing edge including a plurality of termination contacts disposed therealong;

a wing portion extending from each of the side edges of the first and second mating blade, each wing portion engaging one of the slots;

a second mating portion adjacent the first mating portion, the second mating portion including a third and fourth sidewall separated in a horizontal direction by a second intervening space, each of the third and fourth sidewall having two slots;

a third and fourth mating blade horizontally positioned in the second mating portion and arranged in a vertical spaced apart manner, the third and fourth mating blade each including a body portion with a leading edge and a trailing edge, the trailing and leading edge interconnected by two side edges, the leading edge including a plurality of conductive contacts disposed therealong and the trailing edge including a plurality of termination contacts disposed therealong; and a wing portion extending from each of the side edges of the third and fourth mating blade, each wing portion engaging one of the slots.

11. The connector of claim 10, wherein the first and third mating blade lie in a first horizontal plane and the second and fourth mating blade lie in second horizontal plane, the first and second horizontal place substantially parallel to each other.

12. The connector of claim 11, wherein the connector includes a slot disposed between and separating the first and second mating portions.

13. The connector of claim 10, wherein the first and second mating portion are positioned in a horizontal arrangement.

14. The connector of claim 10, wherein the first and second mating portion are positioned in a vertical arrangement.

15. The connector of claim 10, wherein the first mating portion provides a hollow interior portion that at least partially encloses the mating blades, the first mating portion further including a first and second flange disposed on opposite sides of the mating blades.

16. The connector of claim 15, wherein the first flange is shorter than the second flange.

17. The connector of claim 10, further comprising at least one threaded fastener extending from the body portion and configured, in operation, to engage a matching threaded aperture on a mating connector.

* * * * *